US012280303B2

(12) United States Patent
Clark et al.

(10) Patent No.: US 12,280,303 B2
(45) Date of Patent: Apr. 22, 2025

(54) SYSTEMS AND METHODS FOR SECURING BASES, HOME PLATES, PITCHER'S RUBBERS, AND DOUBLE BASES TO SYNTHETIC TURF

(71) Applicant: Sportsfield Intellectual, LLC, Delhi, NY (US)

(72) Inventors: Sean R. Clark, Delhi, NY (US); Eric W. Hulbert, Delhi, NY (US); Daniel J. Sovocool, Sidney Center, NY (US); Brian Jaeger, Peachtree City, GA (US); Alex Fletcher, Hamden, NY (US)

(73) Assignee: Sportsfield Intellectual, LLC, Delhi, NY (US)

( * ) Notice: Subject to any disclaimer, the term of this patent is extended or adjusted under 35 U.S.C. 154(b) by 396 days.

(21) Appl. No.: 17/175,643

(22) Filed: Feb. 13, 2021

(65) Prior Publication Data

US 2021/0252363 A1 Aug. 19, 2021

Related U.S. Application Data

(60) Provisional application No. 62/976,861, filed on Feb. 14, 2020.

(51) Int. Cl.
*A63B 71/00* (2006.01)
*A63B 69/00* (2006.01)
(Continued)

(52) U.S. Cl.
CPC ..... *A63B 69/0013* (2013.01); *A63B 71/023* (2013.01); *A63B 2102/18* (2015.10); *A63B 2102/182* (2015.10)

(58) Field of Classification Search
CPC ..... A63B 69/0013; A63B 71/023; A63B 2102/18; A63B 2102/182
(Continued)

(56) References Cited

U.S. PATENT DOCUMENTS 315,840 A 4/1885 Roberts
468,625 A 2/1892 Medart
(Continued)

FOREIGN PATENT DOCUMENTS

FR 2601061 1/1988

OTHER PUBLICATIONS

Clark et al., U.S. Appl. No. 16/923,448, filed Jul. 8, 2020, entitled "Forms and Methods for Constructing a Foundation for Supporting a Home Plate", Jul. 8, 2020.
(Continued)

*Primary Examiner* — Mitra Aryanpour
(74) *Attorney, Agent, or Firm* — Heslin Rothenberg Farley & Mesiti P.C.

(57) ABSTRACT

An anchor includes a frame assembly and a removable cover plug. The frame assembly includes an access frame having a bottom and a wall defining an upper opening and a cavity therein, a first flexible seal extends above the upper opening of the wall, and at least one vertical member is in communication with the cavity of the access frame. The plug is operable for covering opening in the access frame. The plug includes a platform for supporting synthetic turf on the platform. When the plug is removed, at least one stanchion of a base, a home plate, a double base, or a pitcher's rubber is engageable with the vertical member.

30 Claims, 35 Drawing Sheets

(51) Int. Cl.
*A63B 71/02* (2006.01)
*A63B 102/18* (2015.01)

(58) Field of Classification Search
USPC ..... 473/497
See application file for complete search history.

(56) References Cited

U.S. PATENT DOCUMENTS 1,813,045 A 7/1931 Franks
1,887,033 A 11/1932 Merriman
1,928,280 A 9/1933 Barron
2,014,466 A 9/1935 Cheyney
2,064,751 A 12/1936 Hussman
2,200,859 A 5/1940 Leonard
2,236,935 A 4/1941 Cameron
2,294,855 A 9/1942 Thomason
2,405,492 A * 8/1946 Corbett ..... A63C 19/04 473/499
2,588,722 A 3/1952 Hendershott
2,678,592 A 5/1954 Wiedman
2,828,931 A 4/1958 Harvey
2,960,335 A 11/1960 Shuttleworth
3,222,064 A 12/1965 Langton
3,395,917 A 8/1968 Moore
3,421,801 A 1/1969 Carpenter et al.
3,477,668 A 11/1969 Tippmann
3,493,201 A 2/1970 Marran
3,815,902 A 6/1974 Tomlinson
3,853,220 A 12/1974 Luray
4,089,553 A 5/1978 Frykholm
4,212,446 A 7/1980 Domanick
4,215,857 A 8/1980 Gordon
4,245,838 A 1/1981 Gordon
4,323,034 A 4/1982 Carlson
4,502,656 A 3/1985 Zeitler
4,505,449 A 3/1985 Turner et al.
4,591,154 A * 5/1986 Santarone ..... A63B 69/0002 473/497
4,666,155 A 5/1987 Stille
4,696,470 A 9/1987 Fenner
4,723,779 A * 2/1988 Hauser ..... A63B 69/0013 473/499
4,744,561 A * 5/1988 Hall ..... A63B 71/02 473/501
4,817,946 A * 4/1989 Velasquez ..... A63B 69/0013 473/501
5,080,356 A * 1/1992 Green ..... A63B 69/0013 473/501
5,205,799 A 4/1993 Carbonero
5,259,523 A 11/1993 Scherb
5,467,977 A 11/1995 Beck
5,611,974 A 3/1997 Welch et al.
5,716,295 A 2/1998 Anglea
5,827,140 A * 10/1998 Bartoli ..... A63B 69/0002 473/497
5,894,932 A 4/1999 Harding et al.
6,152,430 A 11/2000 Thoman
6,325,352 B1 12/2001 Story
6,427,966 B1 8/2002 Blumenschein
6,767,296 B1 * 7/2004 Johnson ..... A63B 69/0013 473/499
7,331,880 B2 2/2008 Rogers
7,527,569 B2 5/2009 Rogers
7,641,593 B2 1/2010 Goulet
7,736,274 B2 6/2010 Thibodeaux, Sr.
7,753,826 B1 7/2010 Oliver et al.
7,784,636 B2 8/2010 Goulet
7,798,920 B1 9/2010 Cortes
7,874,943 B1 * 1/2011 Chen ..... A63B 69/0013 473/499
8,016,149 B2 9/2011 Goulet
8,172,705 B2 5/2012 Rogers
8,186,125 B2 5/2012 Goulet
8,186,684 B2 5/2012 Oliver
8,234,888 B2 8/2012 Kim et al.
8,337,318 B2 12/2012 Oliver
8,337,340 B2 12/2012 Clark
8,376,479 B2 2/2013 Furey et al.
8,578,678 B2 11/2013 Oliver
8,745,955 B2 6/2014 Goulet
8,777,784 B2 7/2014 Rogers
8,888,615 B2 11/2014 Hulbert et al.
8,925,280 B2 1/2015 Oliver
8,944,941 B2 2/2015 Carlson et al.
9,844,717 B2 12/2017 Lee et al.
9,932,893 B2 4/2018 Nandigama et al.
10,159,881 B2 12/2018 Hulbert et al.
10,392,156 B2 8/2019 McDonald
10,471,323 B1 11/2019 Carlson et al.
10,604,952 B2 3/2020 Clark et al.
10,737,129 B2 8/2020 Clark et al.
10,828,548 B2 11/2020 Markison
11,072,902 B2 7/2021 Clark et al.
2004/0242352 A1 12/2004 Panus
2005/0172678 A1 8/2005 Kim et al.
2008/0171621 A1 * 7/2008 Jacobson ..... A63B 69/0013 473/499
2008/0305897 A1 12/2008 Hall
2009/0275444 A1 11/2009 Derry
2011/0098139 A1 4/2011 Query, Jr. et al.
2014/0048678 A1 2/2014 Chen et al.
2014/0187361 A1 7/2014 Carlson et al.
2015/0054369 A1 2/2015 Ahlert et al.
2016/0281907 A1 9/2016 Perko
2017/0248268 A1 8/2017 Copanas et al.
2019/0055740 A1 2/2019 Clark et al.
2020/0270880 A1 8/2020 Clark et al.
2021/0252363 A1 * 8/2021 Clark ..... A63B 69/0013 473/499
2022/0010502 A1 1/2022 Clark et al.
2022/0193514 A1 6/2022 Hulbert et al.

OTHER PUBLICATIONS

Clark et al., U.S. Appl. No. 16/826,398, filed Mar. 23, 2020, entitled "Forms For Constructing Foundations For Anchoring Pole Vault Standards,", Mar. 23, 2020.
Communications Box installed at Mynderse Academy, Seneca Falls CSD, New York, installed summer 2012, and image from ComBox installation instructions, 1 page, 2012.
Combox+ Installation Instructions for Synthetic Infill Turf Field Applications For Model # CBIT1830 Combox+ and Model # CBIT1815 Combox+, available form Sportsfield Specialties, Inc., Delhi, New York, 7 pages, 2017.
Hand Formed Concrete Home Plate Foundation, by Clark Companies, 1 image, 1 page, Jul. 23, 2016.
Synthetic Turf Field Home Plate Detail, by Clark Companies, 1 page, Jun. 22, 2016.
Wood Framed Home Plate Foundation, by Vasco Sports Contractors, 4 images, 2 pages, Dec. 10, 2015.
Clark et al., U.S. Appl. No. 18/048,601, entitled "Forms for Constructing a Foundation for Batter's and Catcher's Boxes, and Supporting a Home Plate", filed Oct. 21, 2022.
Home Plate Forming System, available from Sportsfield Specialties of Delhi, New York, printout on Oct. 21, 2022, (Wayback Verification Crawl Presence at https://web.archive.org/web/20200922131545/https://www.sportsfield.com/ products/baseball-softball/bases-plates-pitching-rubbers/home-plate-forming-system#/gallery and https://web.archive.org/web/20210814091931/https://www.sportsfield.com/, dated Sep. 22, 2020, and Aug. 14, 2021), 9 pages, Sep. 22, 2020.
Pitching Mound Forming System, manufactured by Sportsfield Specialties, Inc., Delhi, New York, printout on Dec. 20, 2020, available at https://www.sportsfield.com/products/baseball-softball/pitching-mounds/forming-systems, 10 pages, Dec. 20, 2020.
Porta-Pitch Baseball Pitcher's Mound, manufactured by Sportsfield Specialties, Delhi, Inc., New York, printout on Dec. 20, 2020, Wayback Verification Crawl Presence, https://web.archive.org/web/20190313034947/https://www. sportsfieldspecialties.com/products/baseball-softball/portable-pitching-mounds, 9 pages, Mar. 13, 2019.

(56) References Cited

OTHER PUBLICATIONS

Hand Made Wooden Form, fabricated by Paragon Sports Constructors, 4 images, 2 pages, at least as early as Jun. 6, 2018.
7141 & 7142—National Pole Vault Standards, available from gillathletics.com, printout available online on Jun. 26, 2017, at: https://www.gillathletics.com/files/inst-7141-7142.pdf, 7-pages Jan. 10, 2013.
PVS-NCAA Collegiate Premier Pole Vault Standards, available from Aluminum Athletic Equipment Co., Royersford, Pennsylvania, printout available online on Jun. 26, 2017, at: https://www.aaesports.com/v/vspfiles/assets/docs/pvs-ncaa-packet.pdf, 4-pages Feb. 12, 2012.
Olympian Pole Vault Standards Installation Instructions, available from Stackhouse Athletic Equip Inc., Salem, Oregon, printout available online on Jun. 26, 2017, at: https://www.stackhouseathletic.com/Content/downloads/install/TOPVS-INSTALL.pdf, 4-pages. Dec. 2008.
Hulbert et al., U.S. Appl. No. 17/455,745, filed Nov. 19, 2021, entitled "Forms And Methods For Constructing A Pitching Mound For Use On A Synthetic Turf Field".

* cited by examiner

SYSTEMS AND METHODS FOR SECURING BASES, HOME PLATES, PITCHER'S RUBBERS, AND DOUBLE BASES TO SYNTHETIC TURF

CROSS-REFERENCE TO RELATED APPLICATION

This application claims priority benefit under 35 U.S.C. § 119(e) of U.S. provisional application No. 62/976,861, filed Feb. 14, 2020, entitled "Systems And Methods For Securing Bases, Home Plates, Pitcher's Rubbers, And Double Bases To Synthetic Turf," which application is incorporated herein by reference in its entirety.

FIELD OF THE INVENTION

This present disclosure relates generally to bases, home plates, and pitcher's rubbers, and more particularly to systems and methods for securing bases, home plates, pitcher's rubbers, and double bases for use on synthetic turf for playing baseball and softball.

BACKGROUND

Over the past years, the synthetic turf industry has grown dramatically with the introduction of synthetic infill turf. These synthetic turf fields are much more affordable than earlier turfs and are more player friendly as well. In many situations these fields are used for multiple sports.

Until now there were two main categories of bases that are used for baseball and softball. First, are in-ground bases that utilize some sort of sleeve anchored into the field sub-base. These bases are often used by higher level programs. They are not versatile in that they can only be used in the location that the anchor is installed, they do not allow the flexibility to use in other areas or other fields when scheduling is tight. Second, they are simple rubber bases that are placed on top of the synthetic turf. These bases allow more flexibility, but they move out of place with even the slightest contact.

SUMMARY OF THE INVENTION

Shortcomings of the prior art are overcome and additional advantages are provided through the provision of a method for releasably restraining a base, a home plate, a double base, or a pitcher's rubber on an upper surface of a synthetic turf field. The method includes, for example, removing a cover plug having synthetic turf from a frame assembly fixedly attached to a support structure under the synthetic turf field, the frame assembly having a peripheral wall and a bottom defining a cavity and at least one vertical member accessible via the cavity, positioning at least one downwardly-depending stanchion of the base, the home plate, the double base, or the pitcher's rubber over the cavity in the frame assembly, lowering at least one downwardly-depending stanchion of the base, the home plate, the double base, or the pitcher's rubber to engage the at least one vertical member accessible via the cavity, and disposing a bottom surface of the base, the home plate, the double base, or the pitcher's rubber over the cavity in the frame assembly and on the upper surface of the synthetic turf field around the peripheral wall of the frame assembly in the synthetic turf field.

In another embodiment, an anchor system attachable to a support structure for securing a base, a home plate, a double base, or a pitcher's rubber on synthetic turf for playing baseball and softball includes a frame assembly and a removable cover plug. The frame assembly includes an access frame having a bottom and a wall defining an upper opening and a cavity therein, a first flexible seal extending above the upper opening of the wall of the access frame, and at least one vertical member accessible via the cavity. The removable cover plug is operable for supporting synthetic turf. The frame assembly is fixedly attachable to the support structure under the synthetic turf, and the cover plug is operable for covering the cavity in the access frame. When the cover plug is removed, the base, the home plate, the double base, or the pitcher's rubber is disposable over the upper opening of the access frame with at least one stanchion of the base, the home plate, the double base, or the pitcher's rubber engageable with the at least one vertical member.

In another embodiment, a method for forming an system for releasably restraining a base or home plate on a surface of synthetic turf includes, for example, excavating a portion of a support structure, securing an access frame to cement disposed in the excavated portion of the support structure, the access frame having a cavity and a vertical hollow sleeve having a passageway in fluid communication with the cavity, installing synthetic turf around the cavity of the access frame; and installing a cover plug having synthetic turf in the cavity.

BRIEF DESCRIPTION OF THE DRAWINGS

The subject matter which is regarded as the invention is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure is directed to synthetic turf fields operable for providing multi-use playing surfaces such as for soccer requiring a level field, and baseball and softball requiring a pitcher's rubber, a home plate, and three bases. The present disclosure is designed for use with ground anchor bases, home plates, pitcher's rubbers, and double bases for use on synthetic infill turf. As well be appreciated from the present description, the present disclosure may provide a synthetic turf interface to create a seamless multi-use playing or other use surface. An access frame may provide an infill retainage seal and a perimeter turf attachment ledge. Without the cover plug, the anchor stanchions of the bases, the home plate, and pitcher's rubber and the double bases may be received in and secured in the access frames. With a cover plug, the access frame may provide a level playing field such as for soccer or other sports related or non-sports related use. It will be appreciated that the technique of the present disclosure may be operable for supporting bases, home plates, pitcher's rubbers, and double bases for playing baseball and softball, as will as supporting other types of sports related and non-sport related components or devices for other purposes on a synthetic turf field, while also allowing a use of the synthetic turf field as a level synthetic turf field when the components or devices are not required.

Synthetic turf infill material generally includes synthetic turf fibers, manufactured to resemble natural grass, and an infill material that stabilizes and cushions the playing surface. The fibers are typically made from nylon, polypropylene or polyethylene. The infill material typically includes granulated crumb rubber (usually from used tires) and sand which is worked in between the fibers during the installation process. The fibers are connected to a backing material, extend through and out from and above the infill material.

Figure 1:
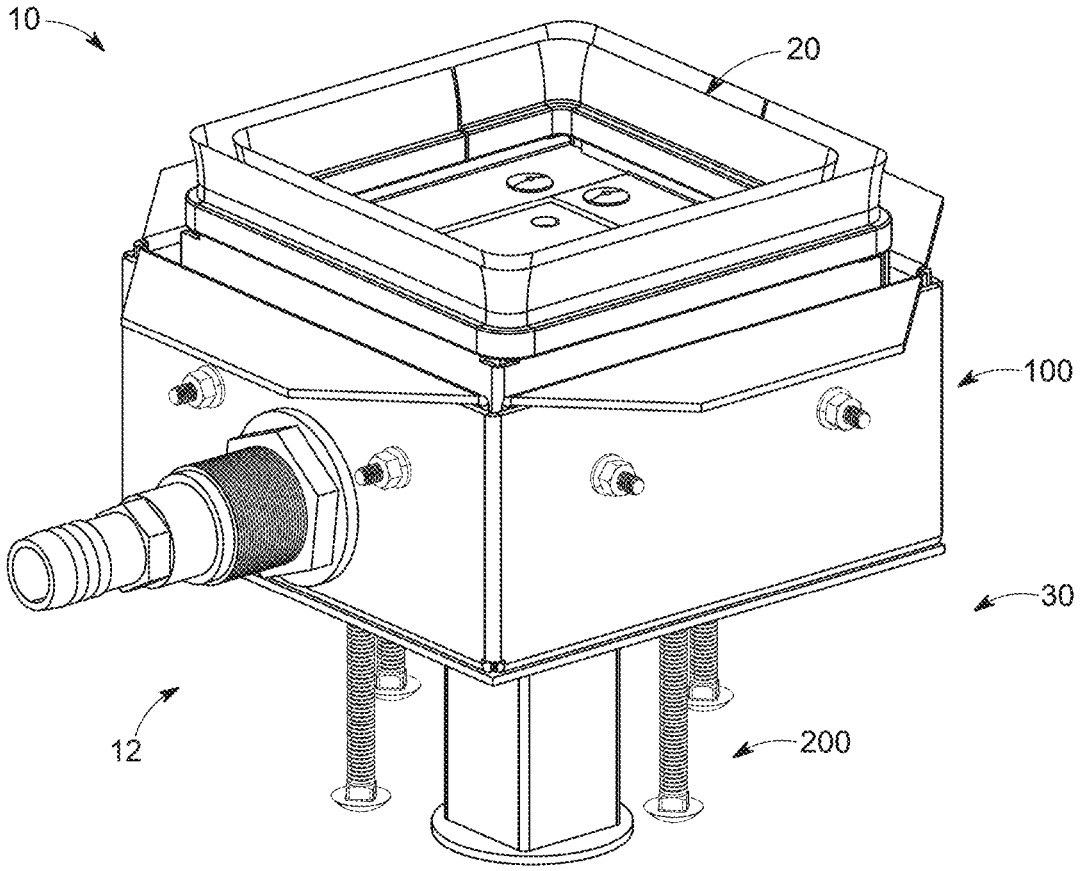
FIG. 1 is a perspective view of an anchor system having the cover plug and a frame assembly for securing a base or a home plate to a surface of a synthetic turf, according to an embodiment of the present disclosure.
Figure 2:
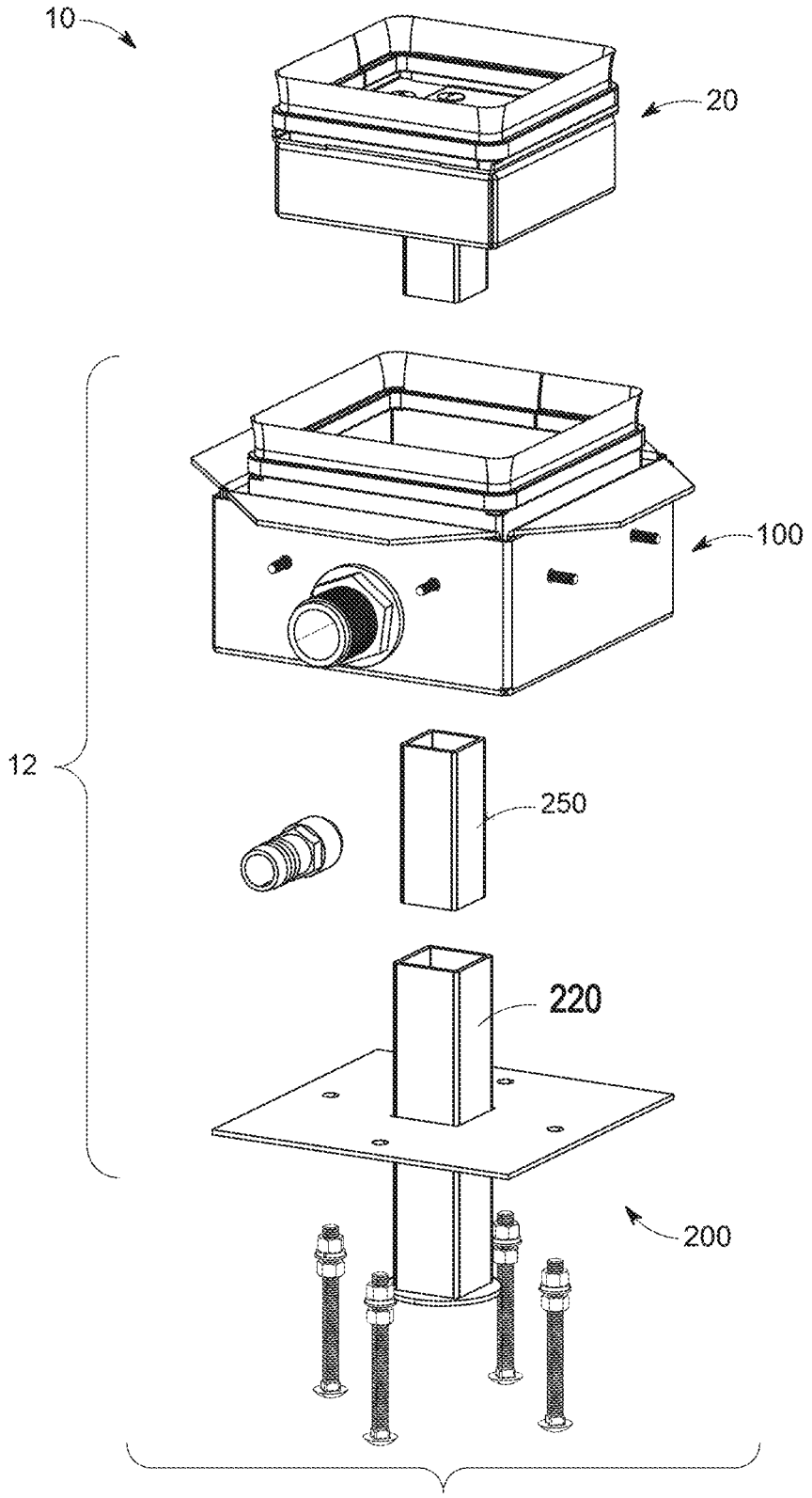
FIG. 2 is an exploded perspective view of the anchor system of FIG. 1, according to an embodiment of the present disclosure.
Figure 3:
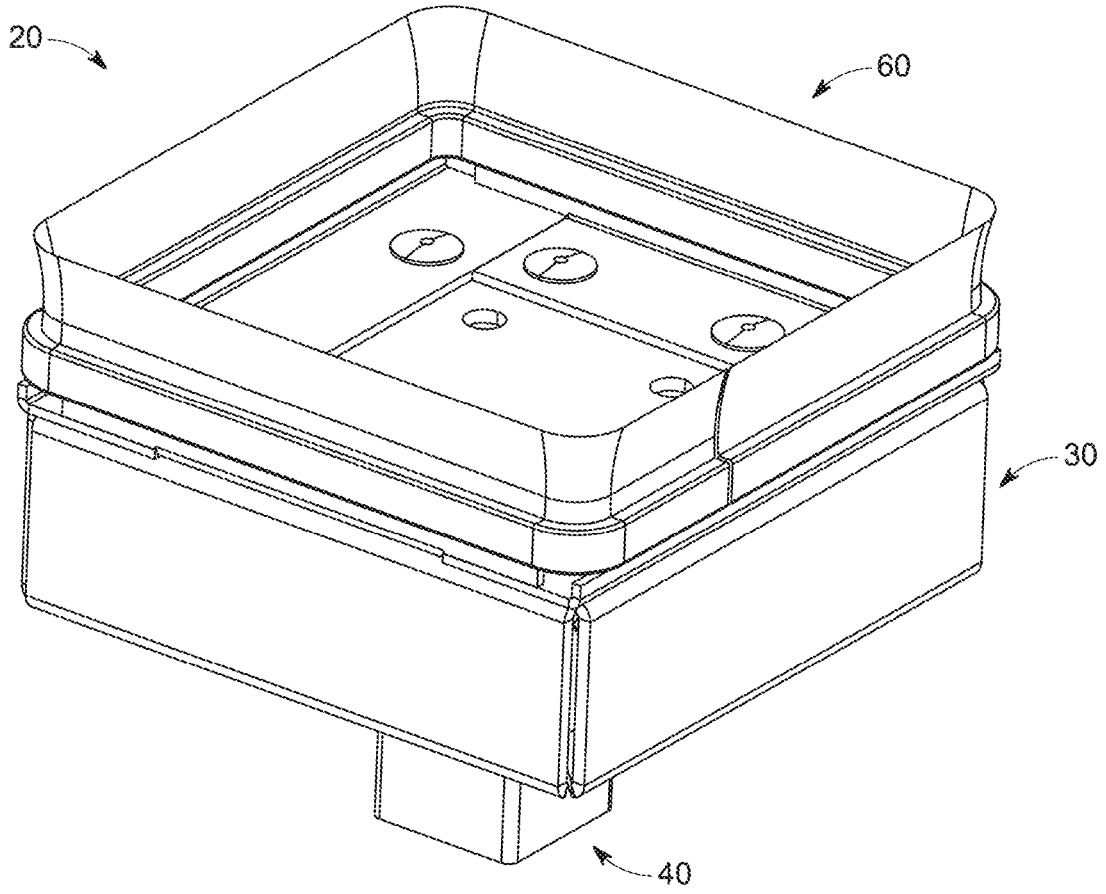
FIG. 3 is a top perspective view of the cover plug of the anchor system of FIG. 1, according to an embodiment of the present disclosure.
Figure 4:
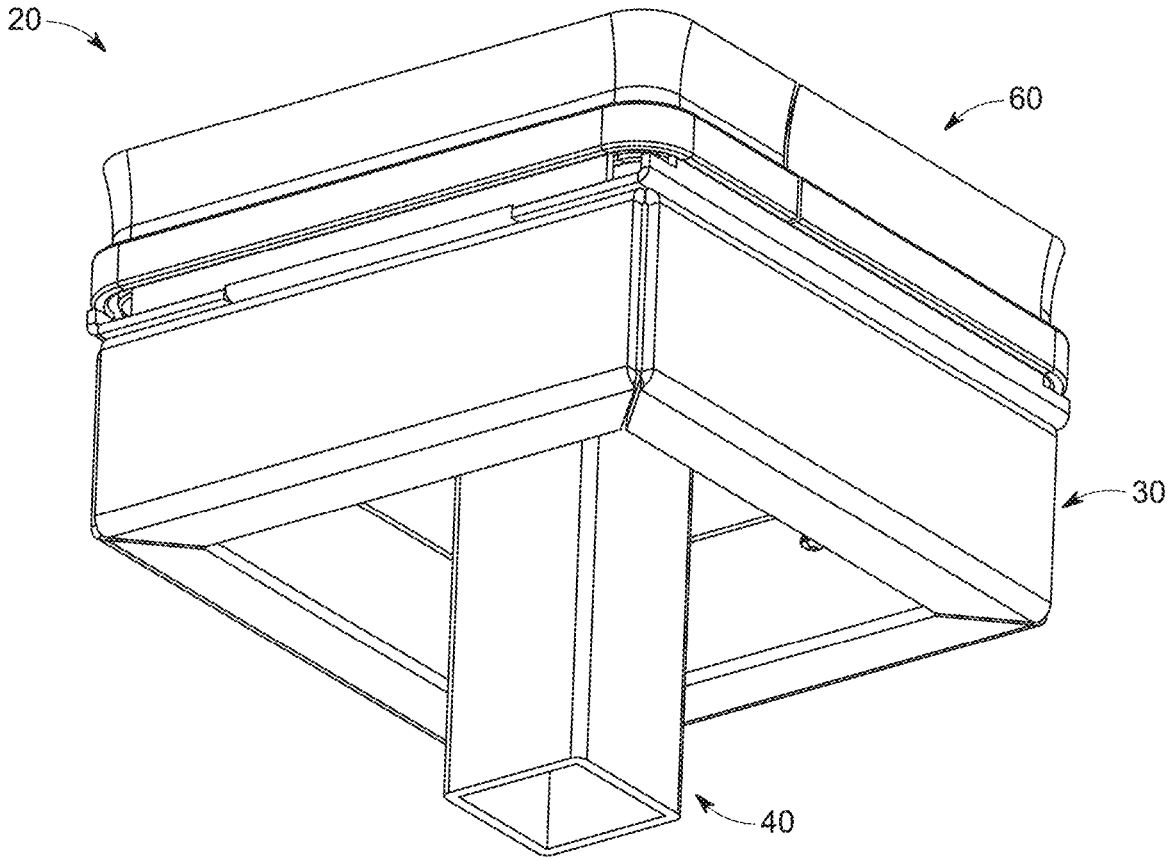
FIG. 4 is a bottom perspective view of the cover plug of the system of FIG. 3, according to an embodiment of the present disclosure.

FIGS. 1 and 2 illustrate an anchor system 10, which may be employed with a synthetic turf infill material, according to an embodiment of the present disclosure. For example, system 10 may be operable with a base or home plate for playing baseball or softball, or for providing a level playing field. In this illustrated embodiment, system 10 may include a removable cover plug 20, and a frame assembly 12. Frame assembly 12 may include an access frame 100 having a base support 200 for fixedly securing system 10 in a support structure such as to a concrete footing in the ground. The base support 200 may include a vertical member such as a vertical hollow sleeve 220. As described in greater detail below, cover plug 20 having synthetic turf infill material 21 (FIG. 7) is receivable in access frame 100 for providing a level playing field with the surrounding synthetic turf infill material such as for a field for playing soccer. As described below, with cover plug 20 removed, access frame 100 provides an anchor for receiving a stanchion of a first base, a second base, a third base, or a home plate for securing the first base, the second base, the third base, or the home plate on the synthetic turf surface.

FIGS. 3-7 illustrate cover plug 20, according to an embodiment of the present disclosure. In this illustrated embodiment, cover plug 20 may include a body 30, a stanchion 40, a plurality of seal supports 50 (FIG. 5), and a resilient or flexible seal 60.

Figure 5:
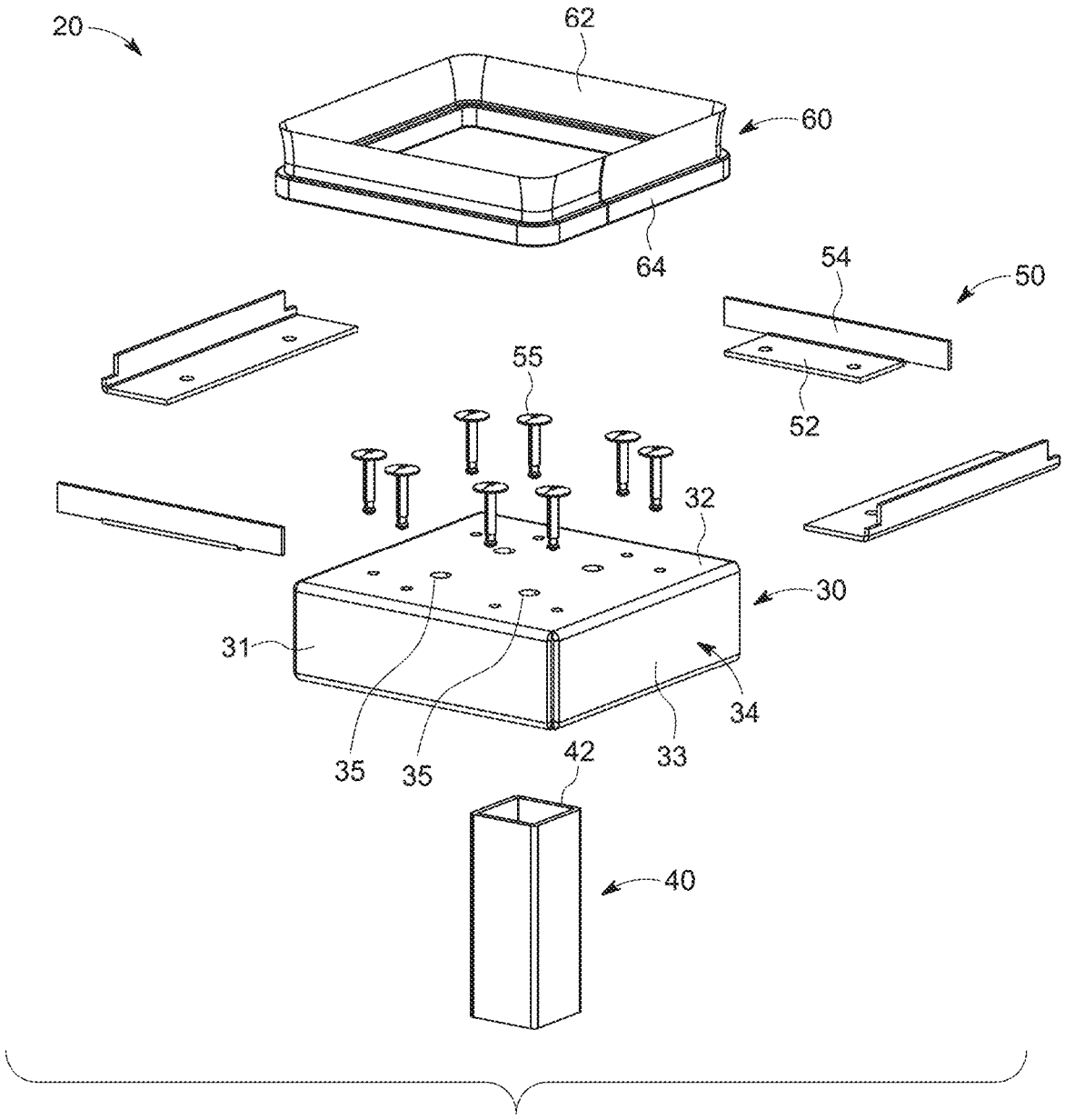
FIG. 5 is an exploded, top perspective view of the cover plug of FIG. 3, according to an embodiment of the present disclosure.
Figure 6:
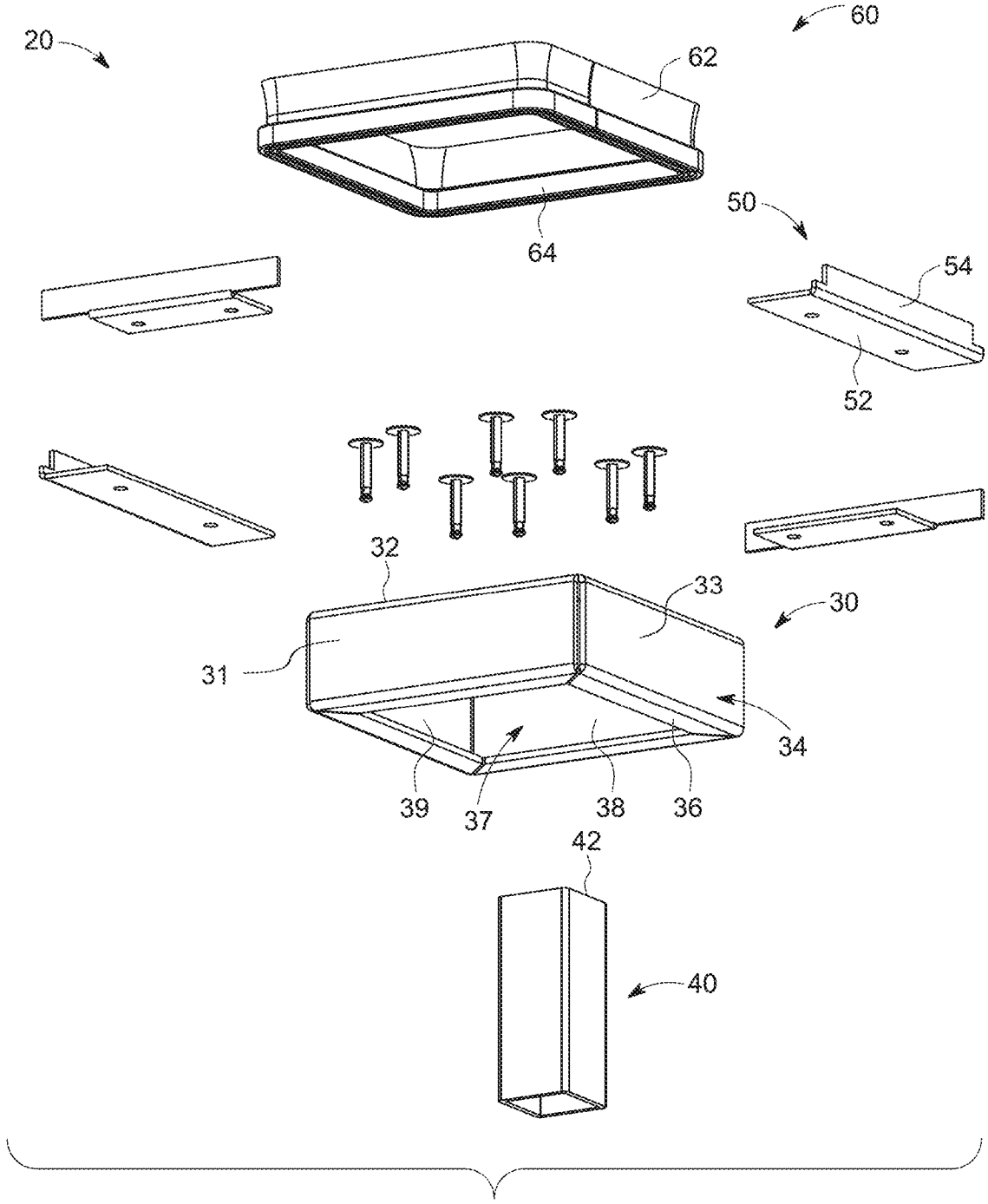
FIG. 6 is an exploded, bottom perspective view of the cover plug of FIG. 3, according to an embodiment of the present disclosure.

As shown in FIGS. 5 and 6, body 30 may be formed from a planar member with folded sides to provide a platform or a top side 32, a peripheral side 34, and a lower inwardly-extending wall 36 (FIG. 6). The peripheral side 34 may include a first side 31, a second side 33, a third side 38 (FIG. 6) opposite the first side 31, and a fourth side 39 (FIG. 6) opposite the second side 33. The adjacent sides may be disposed at ninety degrees from each other. Body 30 may form a cavity 37 (FIG. 6) therein. Stanchion 40 may be a square tube having an upper end 42 operably attached, e.g., welded, to a lower surface of top side 32 of body 30. Top side 32 of body 30 may include a plurality of through-holes 35 to allow for drainage of water or rain through body 30.

Figure 7:
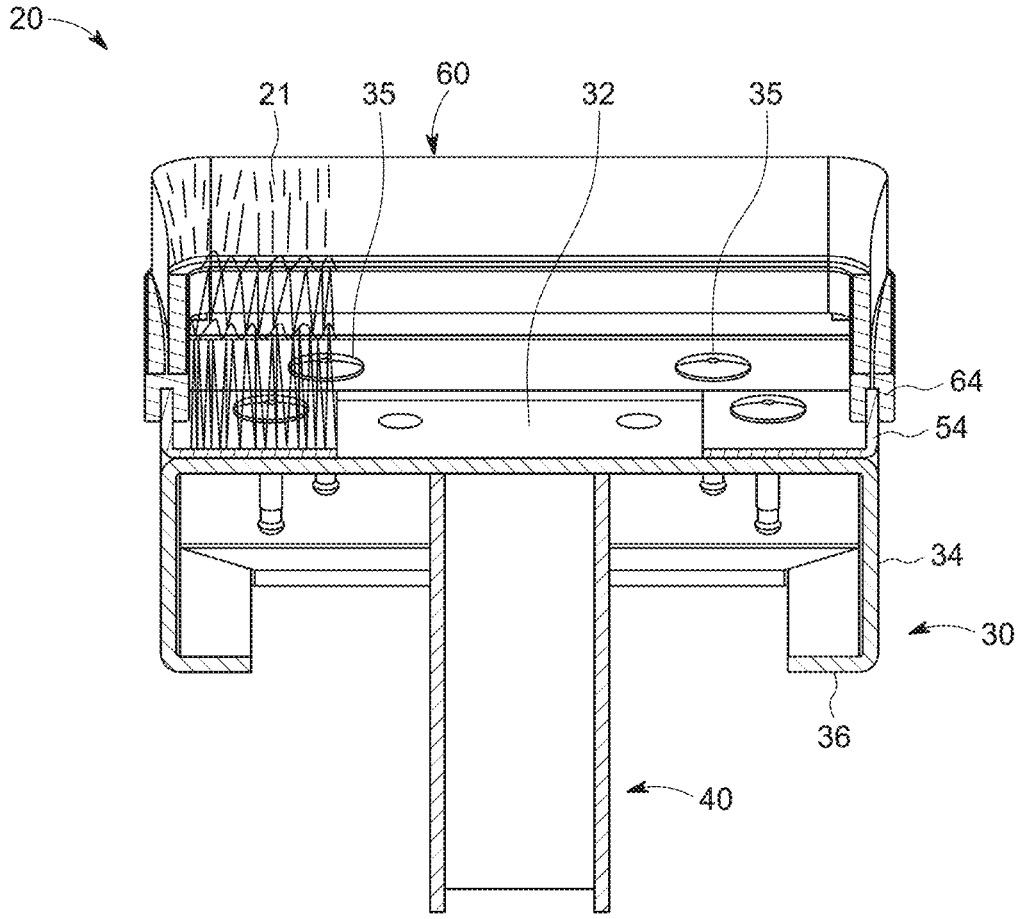
FIG. 7 is a cross-sectional view of the cover plug of FIG. 3, according to an embodiment of the present disclosure.
Figure 8:
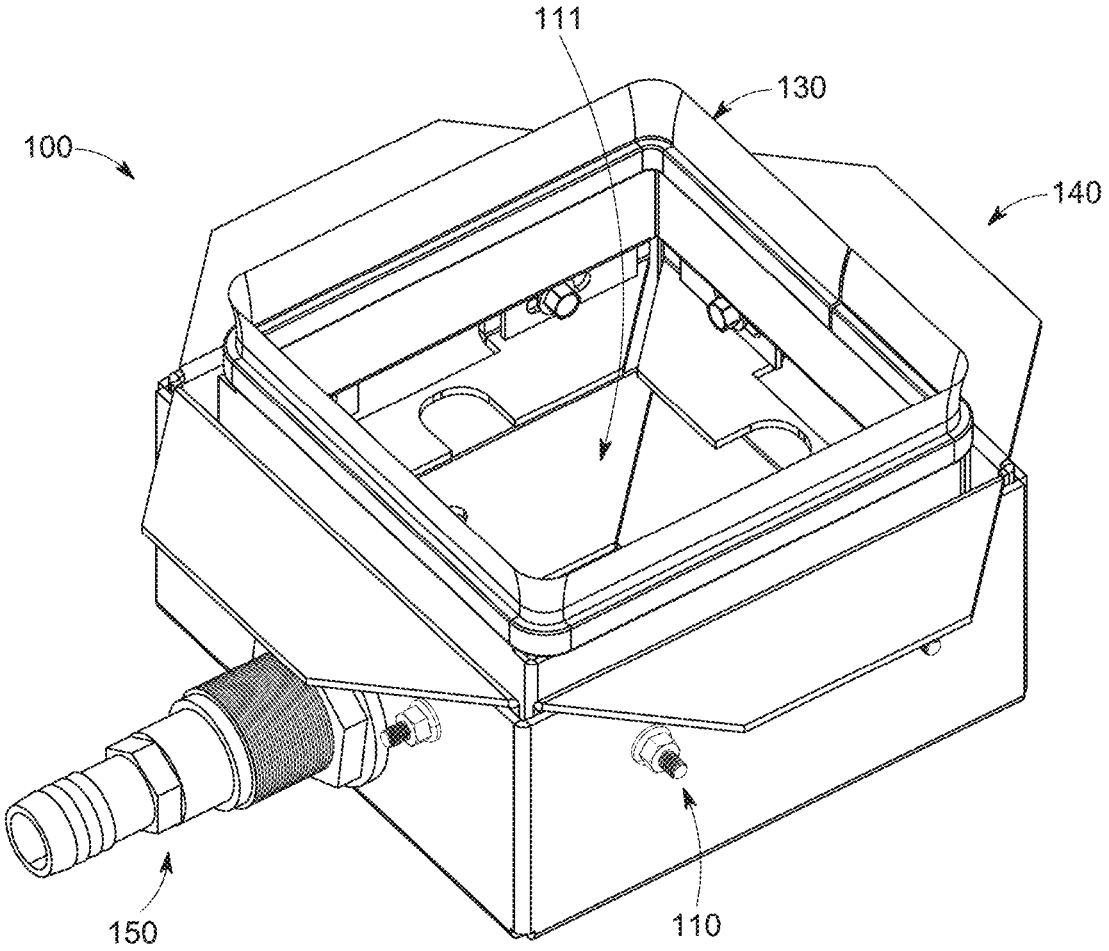
FIG. 8 is a top perspective view of the access frame of the anchor system of FIG. 1, according to an embodiment of the present disclosure.

Each of the plurality of seal supports 50 may be generally L-shaped having a horizontal leg 52 and a vertical leg 54. Inwardly-extending horizontal leg 52 may be secured to top side 32 of body 30 with suitable fasteners 55. The assembled vertical legs 52 may define a peripheral wall for supporting flexible seal 60. Flexible seal 60 may include an upper portion 62 and a downwardly-depending U-shaped portion 64. As shown in FIG. 7, downwardly-depending U-shaped portion 64 is positionable over the vertical legs 54 of the plurality of seal supports 50.

As shown in FIGS. 8-12, access frame 100 may generally include a body 110, a seal supports 120 (FIGS. 10 and 11), a resilient or flexible seal 130, a plurality of turf ledges 140, and a drain 150, according to an embodiment of the present disclosure.

Figure 9:
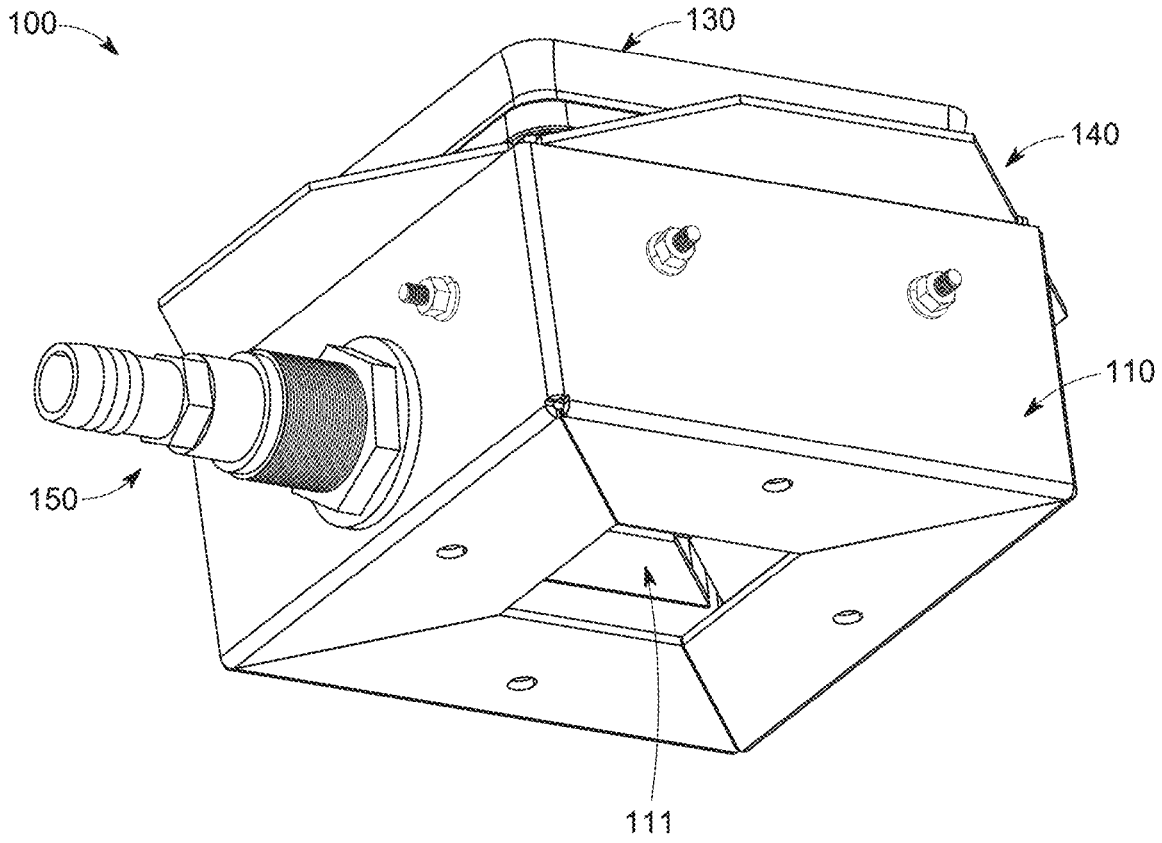
FIG. 9 is a bottom perspective view of the access frame of FIG. 8, of the system of FIG. 1, according to an embodiment of the present disclosure.
Figure 10:
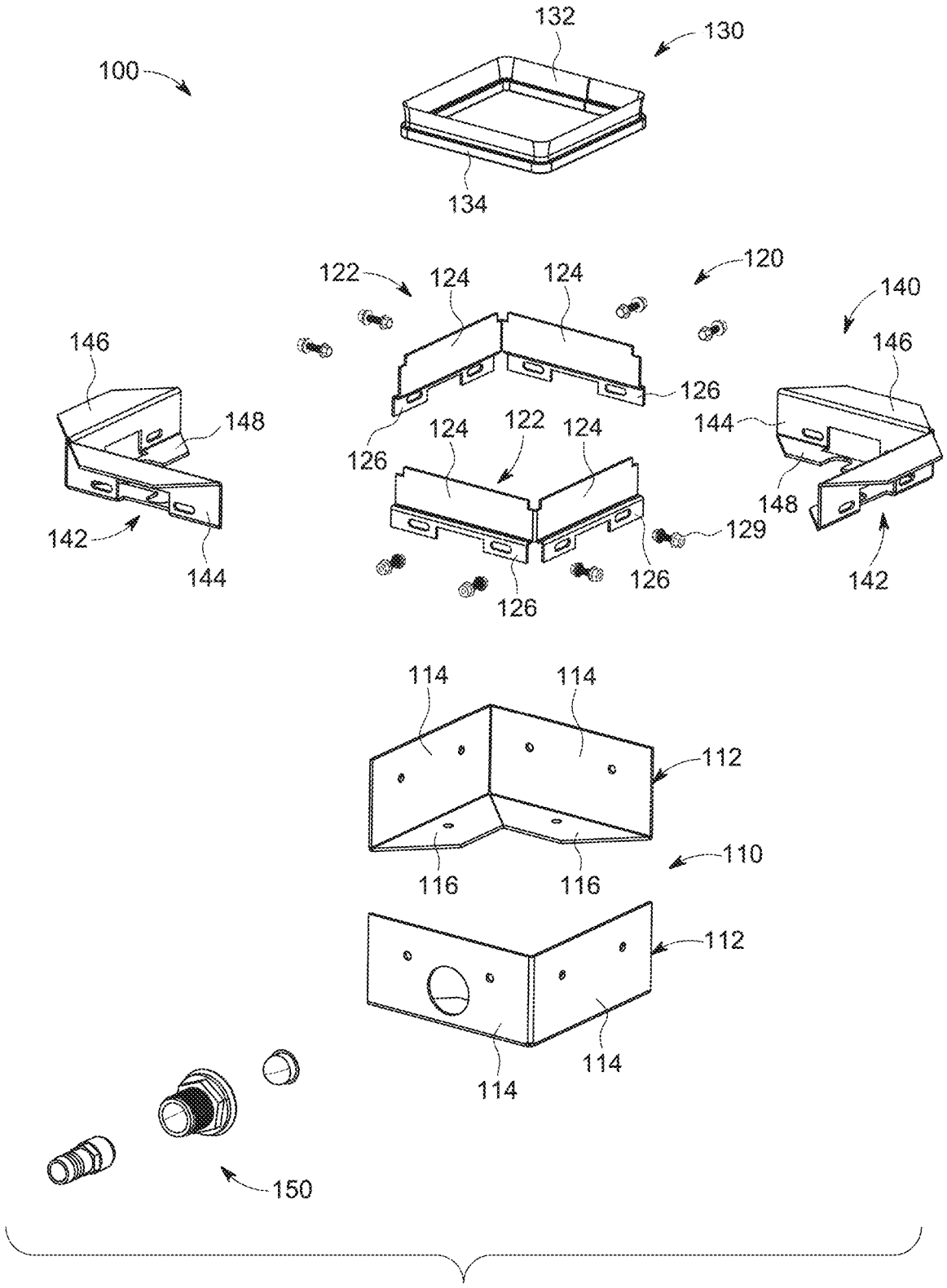
FIG. 10 is an exploded, top perspective view of the access frame of FIG. 8, according to an embodiment of the present disclosure.
Figure 11:
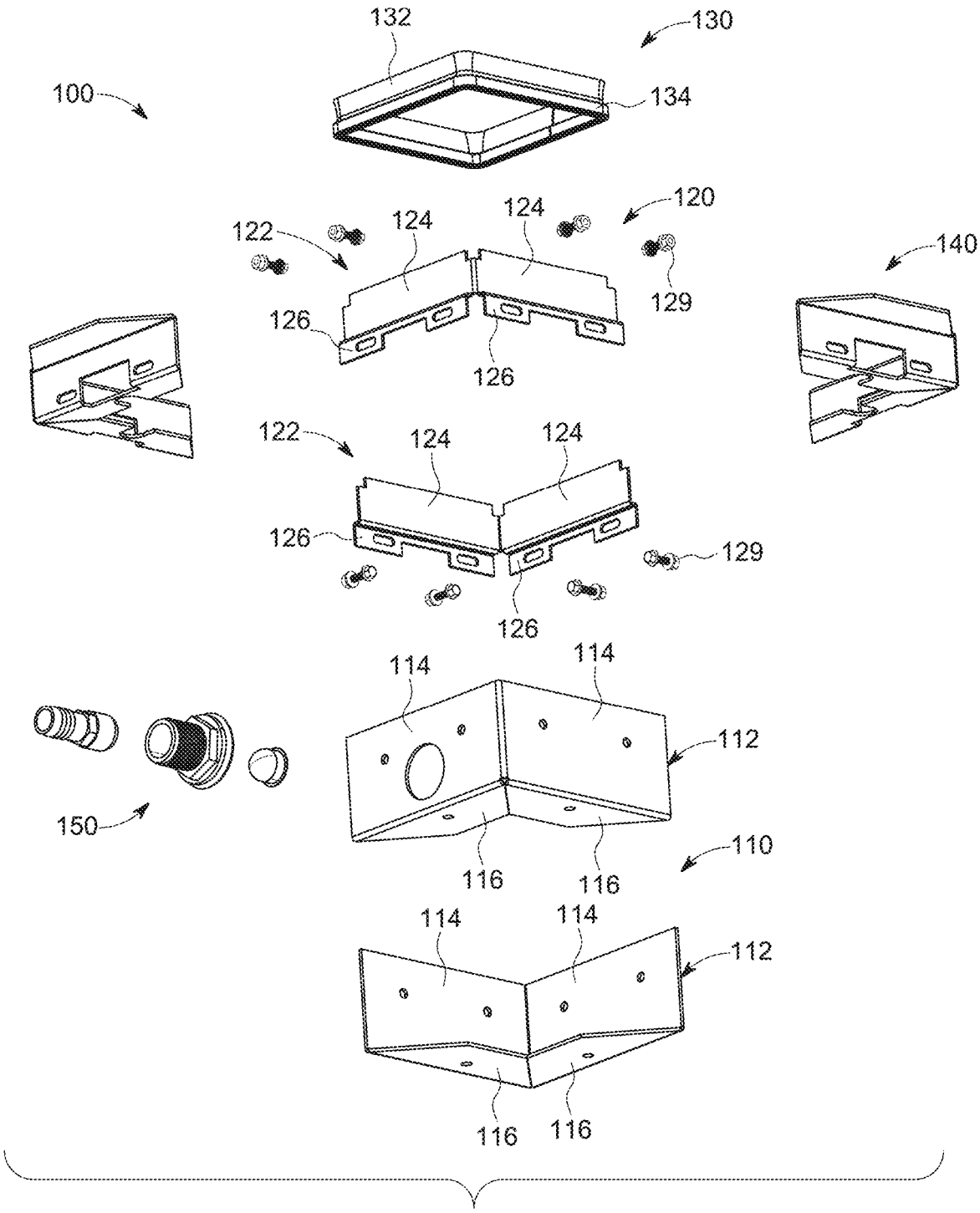
FIG. 11 is an exploded, bottom perspective view of the access frame of FIG. 8, according to an embodiment of the present disclosure.

In this illustrated embodiment, with reference to FIGS. 10 and 11, body 110 may be formed from a pair of half sections 112. Each half section 112 may be formed from a planar member with folded sides to provide a pair of vertical walls 114 disposed at ninety degrees from each other, and a pair of horizontal walls 116. When each half section 112 is assembled, vertical walls 114 define a cavity 111 (FIGS. 8 and 9) sized for receiving cover plug 20 (FIG. 3), and horizontal walls 116 define a bottom having a square opening as shown in FIG. 9. As described below, body 110 may be assembled by attaching each of the half sections 112 to a plate 210 of base support 200 (FIG. 13).

Figure 12:
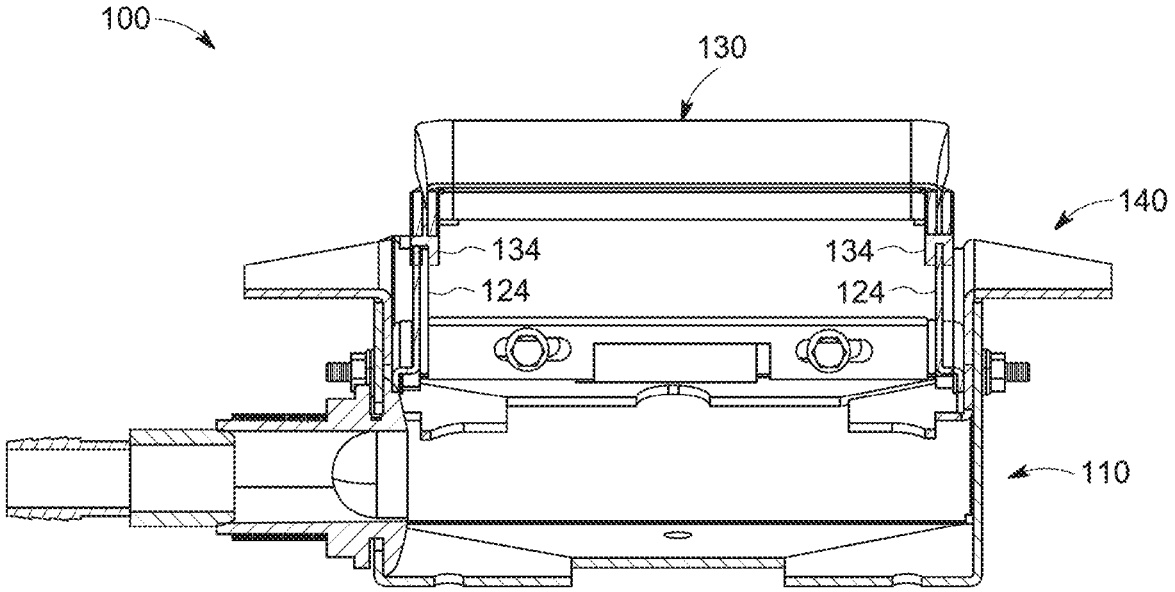
FIG. 12 is a cross-sectional view of the access frame of FIG. 8, according to an embodiment of the present disclosure.

With reference again to FIGS. 10 and 11, the plurality of seal supports 120 may be formed from a pair of half sections 122. Each half section 122 may be formed from a planar member with folded sides to provide a pair of vertical walls 124 disposed at ninety degrees from each other, and a pair of offset vertical walls 126 disposed at ninety degrees from each other. Offset vertical walls 126 are attachable to inner surfaces of support vertical walls 114 with a plurality of bolts 129. Flexible seal 130 may include an upper portion 132 and a downwardly-depending U-shaped portion 134. As shown in FIG. 12, downwardly-depending U-shaped portion 134 of the flexible seal 130 is positionable over vertical walls 124.

With reference again to FIGS. 10 and 11, the plurality of turf ledges 140 may be formed from a pair of half sections 142. Each half section 142 may be formed from a planar member with folded sides to provide a pair of center vertical walls 144 disposed at ninety degrees from each other, a pair of upper horizontal ledges 146 disposed at ninety degrees from each other, and a pair of lower horizontal portions 148 disposed at ninety degrees from each other. The plurality of turf ledges 140 may be secured with bolts 129.

Figure 13:
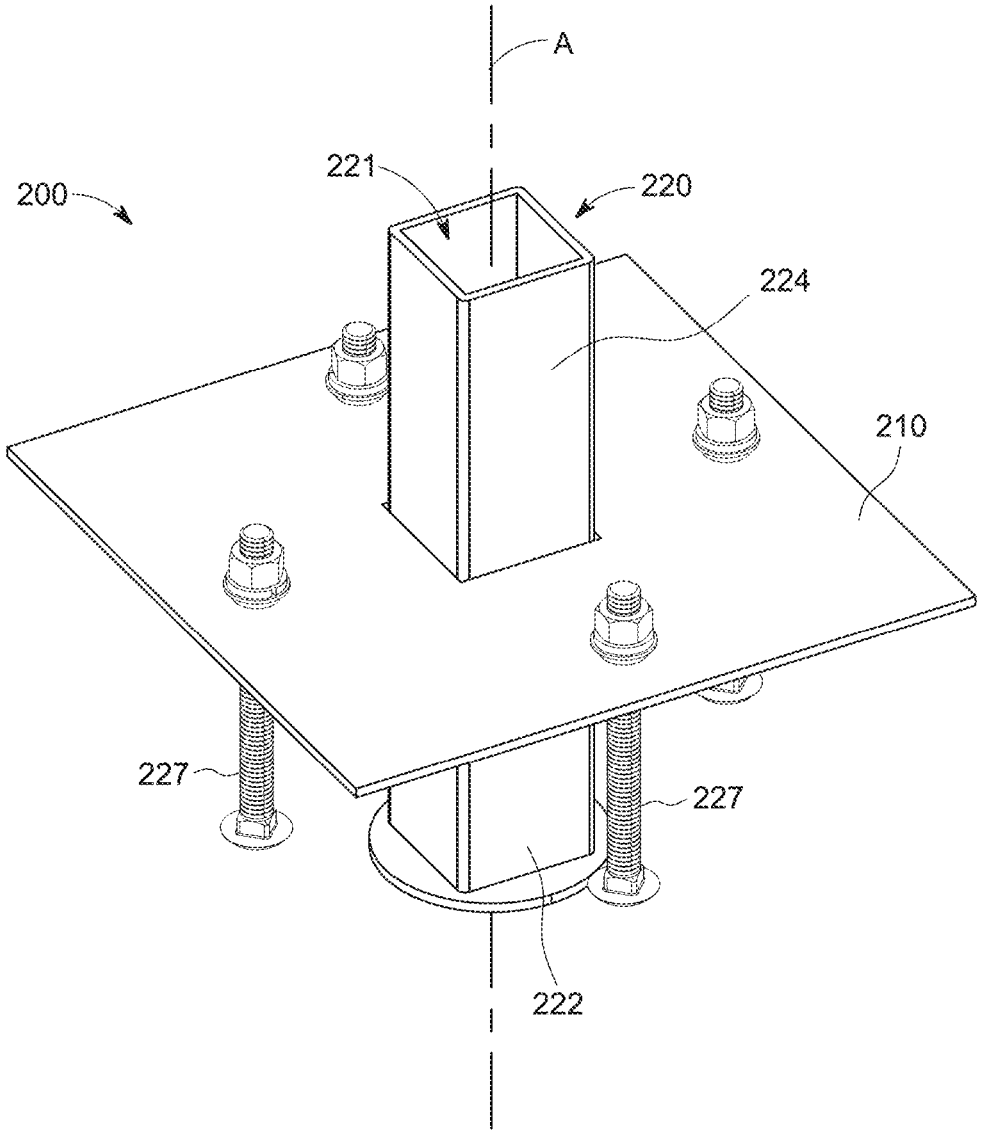
FIG. 13 is a perspective view of a base support of the frame assembly of FIG. 2 and a base, according to an embodiment of the present disclosure.

With reference to FIG. 13, base support 200 is operable for fixedly securing the anchor system 10 (FIG. 1) in a support structure such as the ground. Base support 200 may include horizontal plate 210, having an opening sized for receiving hollow sleeve 220 such as a square tube having a passageway 221 therein. A lower portion 222 of hollow sleeve 220 is disposed below plate 210 and an upper portion 224 of hollow sleeve 220 is disposed above plate 210. Plate 210 may be disposed perpendicular to or at ninety degrees from an axis A of hollow sleeve 220.

Figure 14:
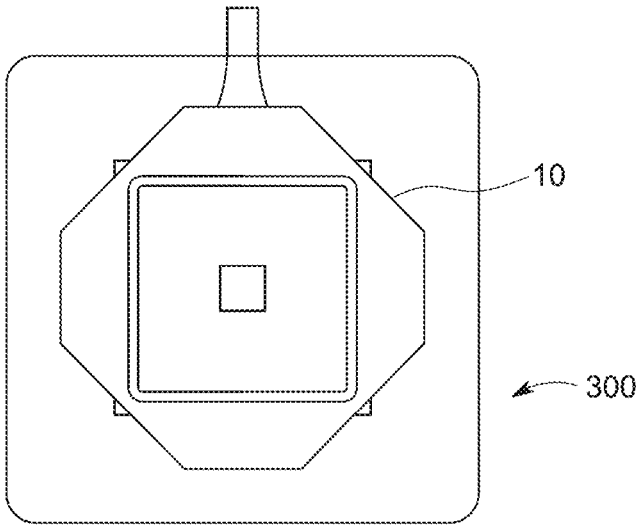
FIG. 14 is a top view of the anchor system and the base of FIG. 4, according to an embodiment of the present disclosure.
Figure 15:
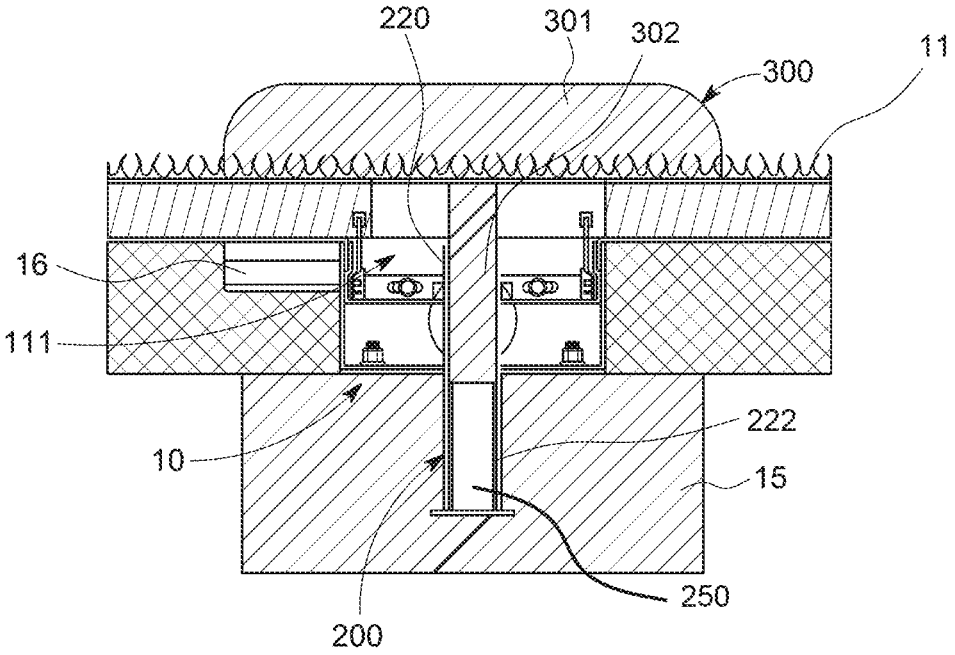
FIG. 15 is a cross-sectional view of the base and the system of FIG. 1, according to an embodiment of the present disclosure.

FIG. 14 illustrates a base 300 positioned over and secured to anchor system 10, according to an embodiment of the present disclosure. For example, base 300 is inhibited from horizontal movement relative to the surface of a synthetic field 11 (FIG. 15). As shown in FIG. 15, a stanchion 302 of base 300 extends into cavity 111 of access frame 100 and a lower portion of stanchion 302 is disposed in passageway 221 (FIG. 13) of hollow sleeve 220 of base support 200, e.g., passageway 221 (FIG. 13) is in fluid communication with cavity 111. A stanchion support, spacer tube or block 250 (also shown in FIG. 2) may be disposed in passageway 221 (FIG. 13) for supporting the bottom of stanchion 302. The lower portion of base support 200, e.g., a lower portion of hollow sleeve 220 and bolts 227 (FIG. 13) may be installed in a concrete footing 15 disposed in the ground. An optional nailer board 16 may be provided. A plurality of anchor systems 10 may be suitable disposed in the support structure or ground under the artificial turf field at the desired locations for a first base, a second base, a third base, and a home plate. With the bases removed, the cover plugs having synthetic turf may be reinstalled in the access frames 100 to provide a level playing field.

Figure 16:
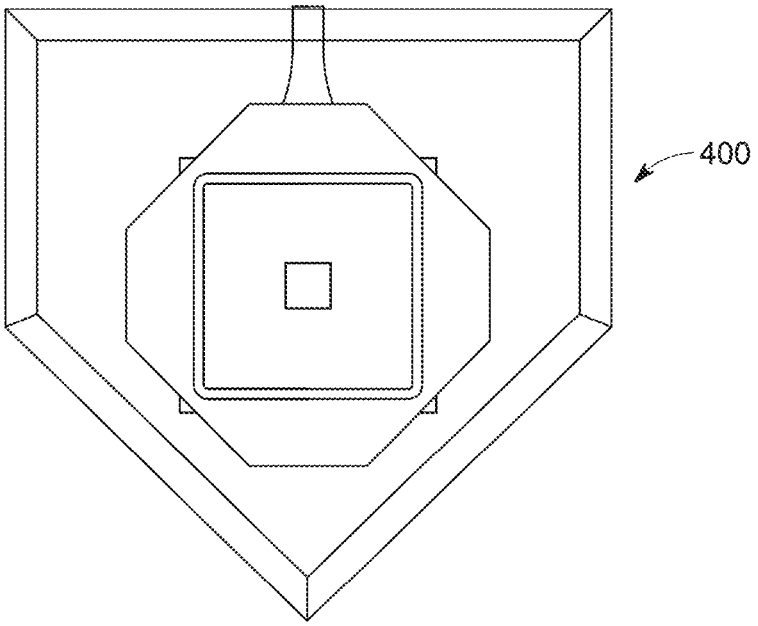
FIG. 16 is a top view of the anchor system of FIG. 1 and a home plate, according to an embodiment of the present disclosure.
Figure 17:
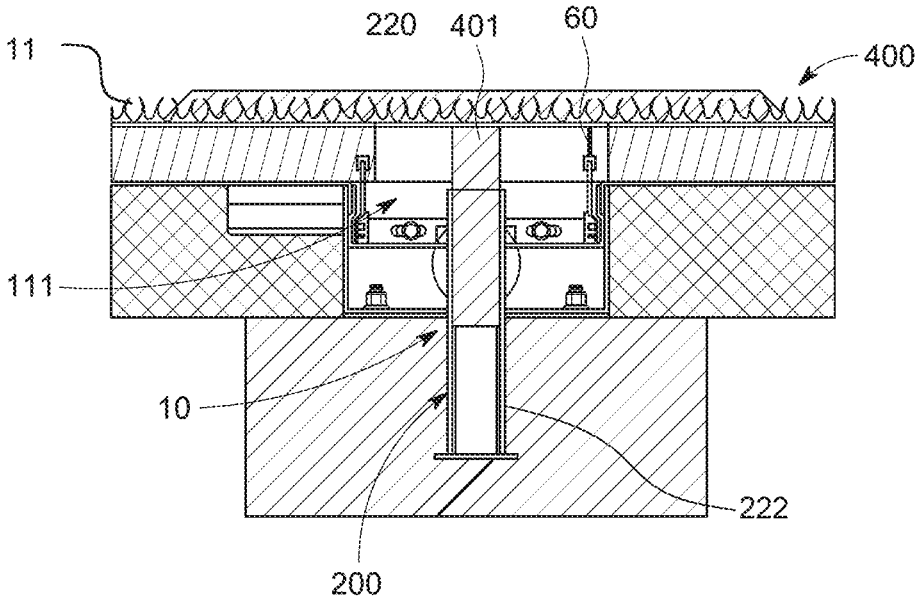
FIG. 17 is a cross-sectional view of anchor system and home plate of FIG. 16, according to an embodiment of the present disclosure.

FIG. 16 illustrates a home plate 400 positioned over and secured to anchor system 10, according to an embodiment of the present disclosure. For example, home plate 400 is inhibited from horizontal movement relative to the surface of synthetic field 11 (FIG. 17). As shown in FIG. 17, a lower portion of a stanchion 401 of home plate 400 extends into cavity 111 of access frame 100 and a lower portion of stanchion 401 is disposed in hollow sleeve 220 of base support 200. The lower portion of base support 200, e.g., lower portion 222 of hollow sleeve 220 and bolts 227 (FIG. 13) may be installed in a concrete footing 15. With the home plate removed, the cover plug having synthetic turf may be reinstalled in the access frame 100 to provide a level playing field.

As will be appreciated, the system 10 with flexible seal 60 aids in inhibiting material such as infill material, e.g., a sand/rubber mixture, associated with artificial turf from falling into access frame 100 when the cover plug of system 10 is removed.

Figure 18:
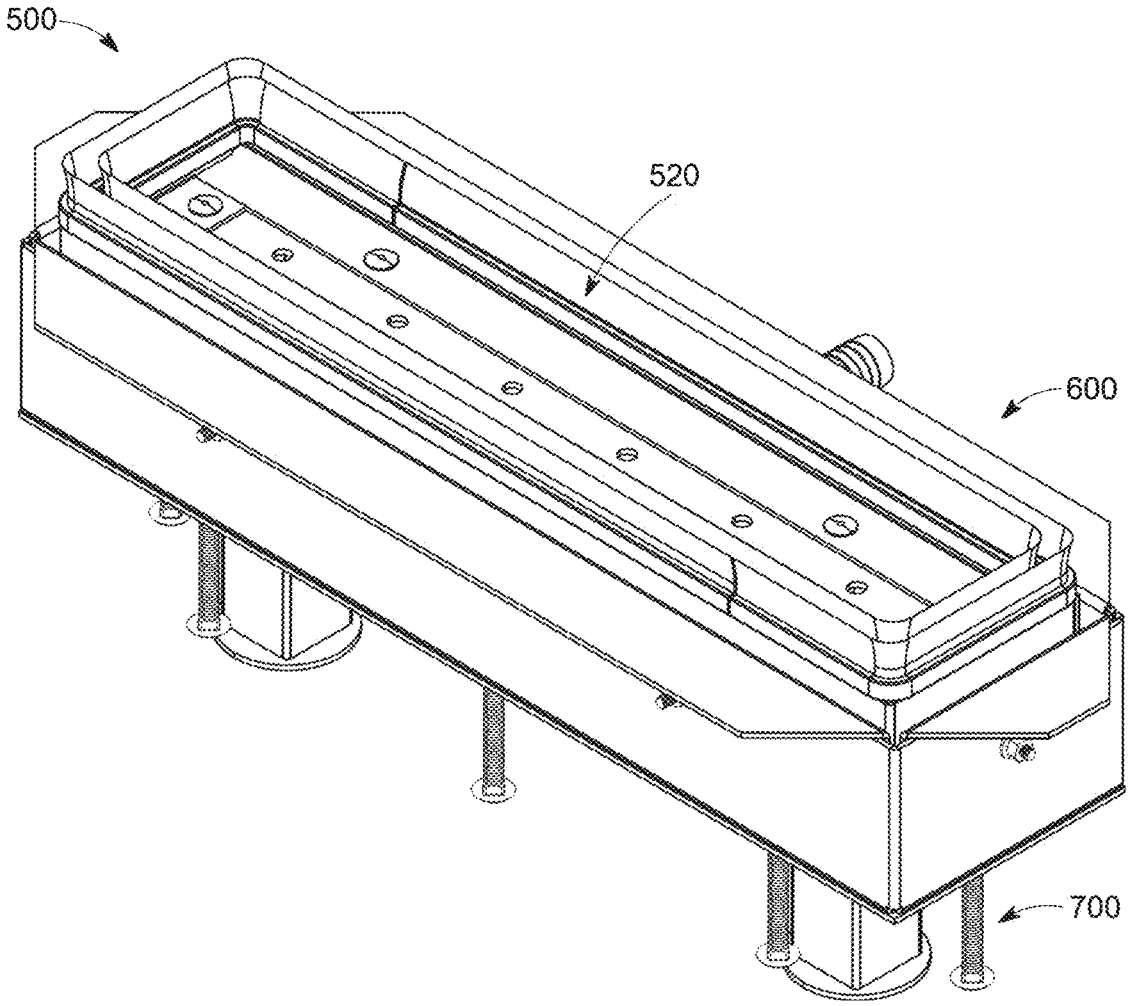
FIG. 18 is a perspective view of an anchor system for securing a pitcher's rubber or a double base or a surface of synthetic turf, according to an embodiment of the present disclosure.
Figure 19:
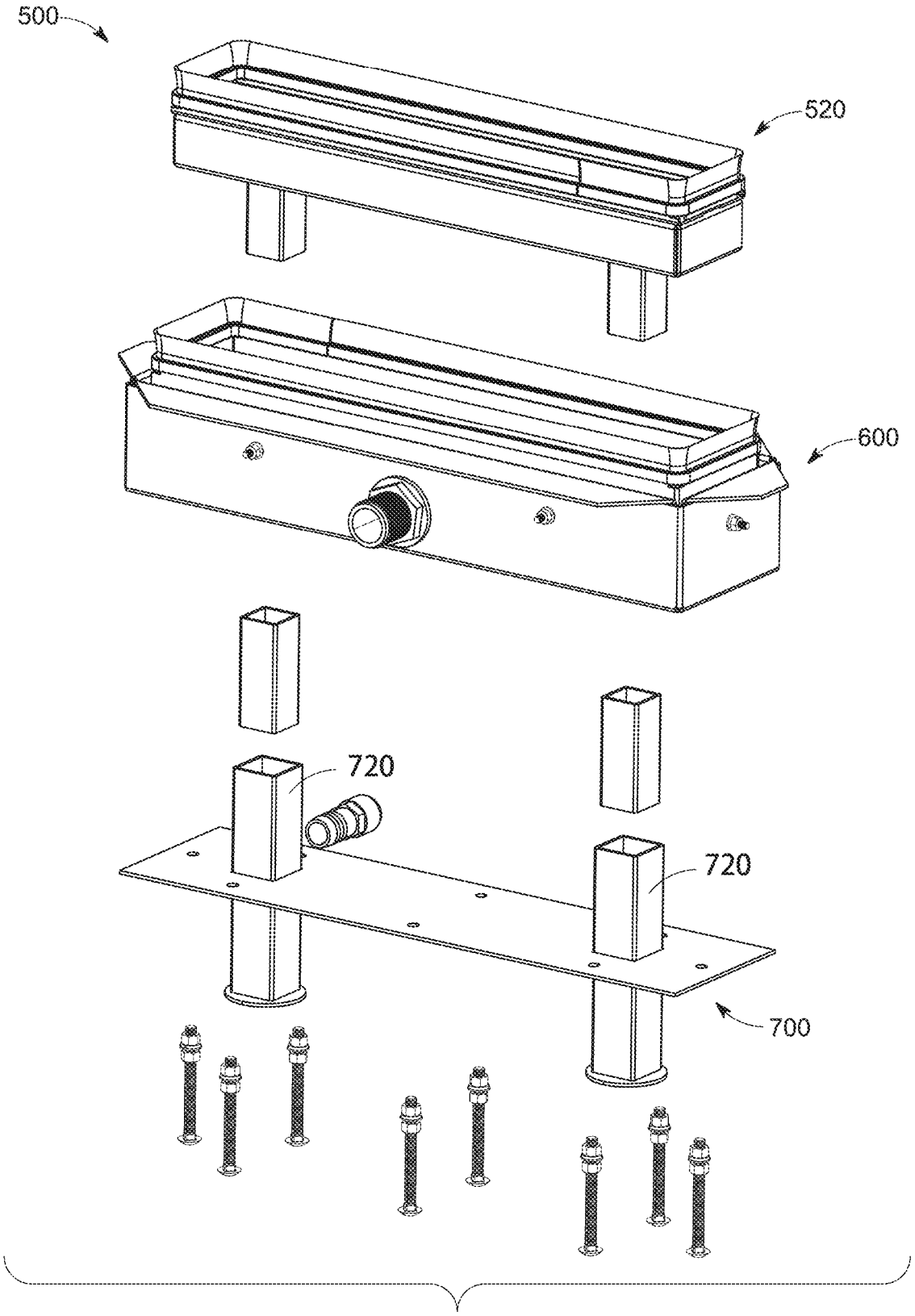
FIG. 19 is an exploded perspective view of the anchor system of FIG. 18, according to an embodiment of the present disclosure.
Figure 20:
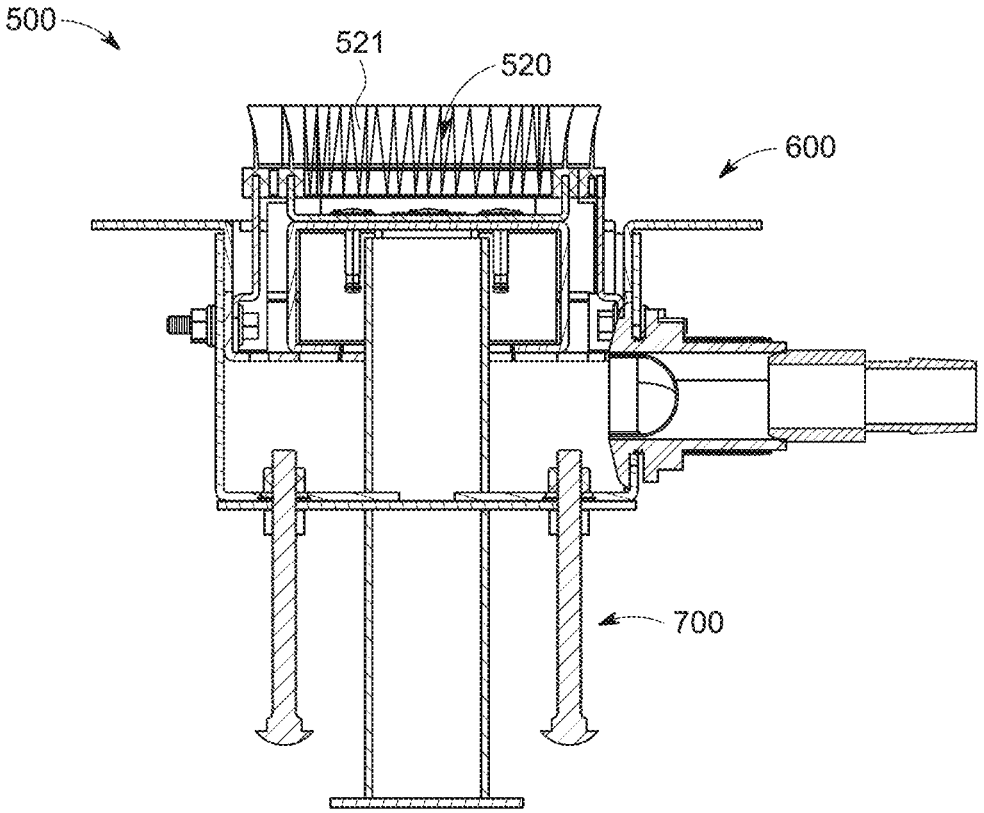
FIG. 20 is a cross-sectional view of the anchor system of FIG. 18, according to an embodiment of the present disclosure.
Figure 21:
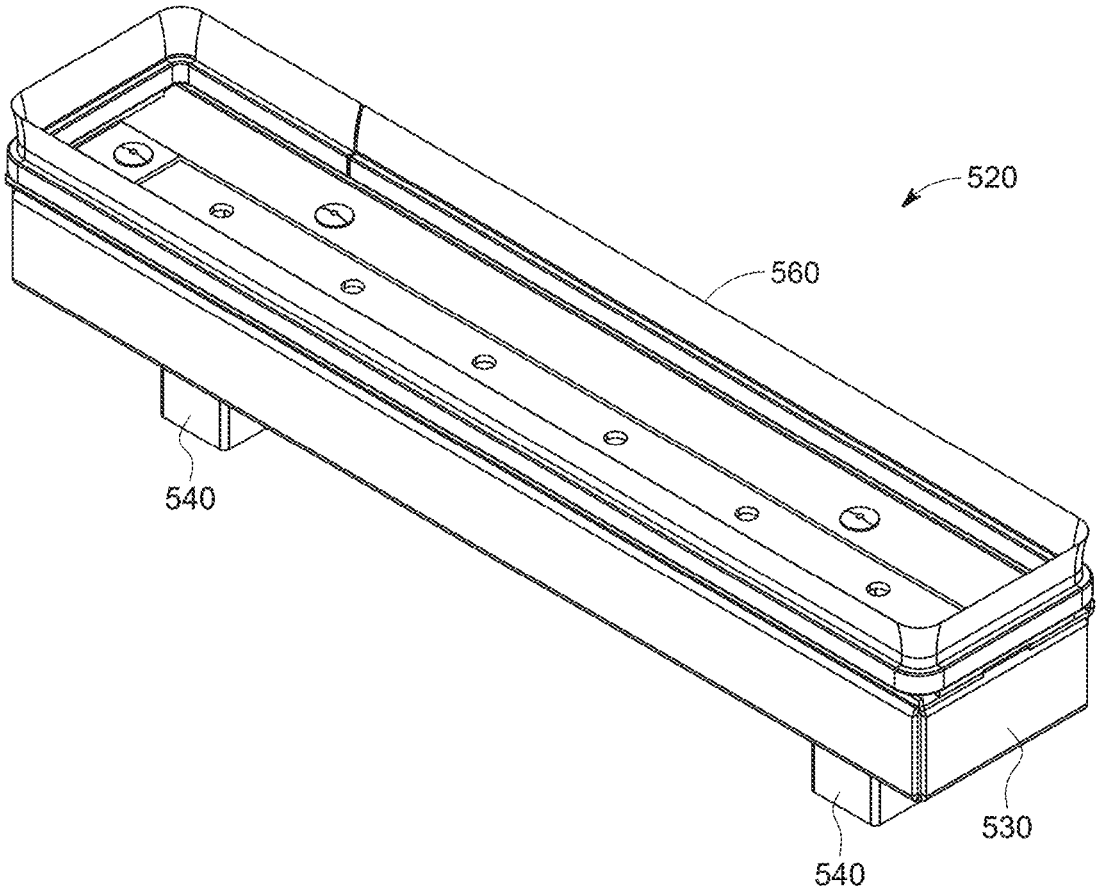
FIG. 21 is a top perspective view of the cover plug of the anchor system of FIG. 18, according to an embodiment of the present disclosure.
Figure 22:
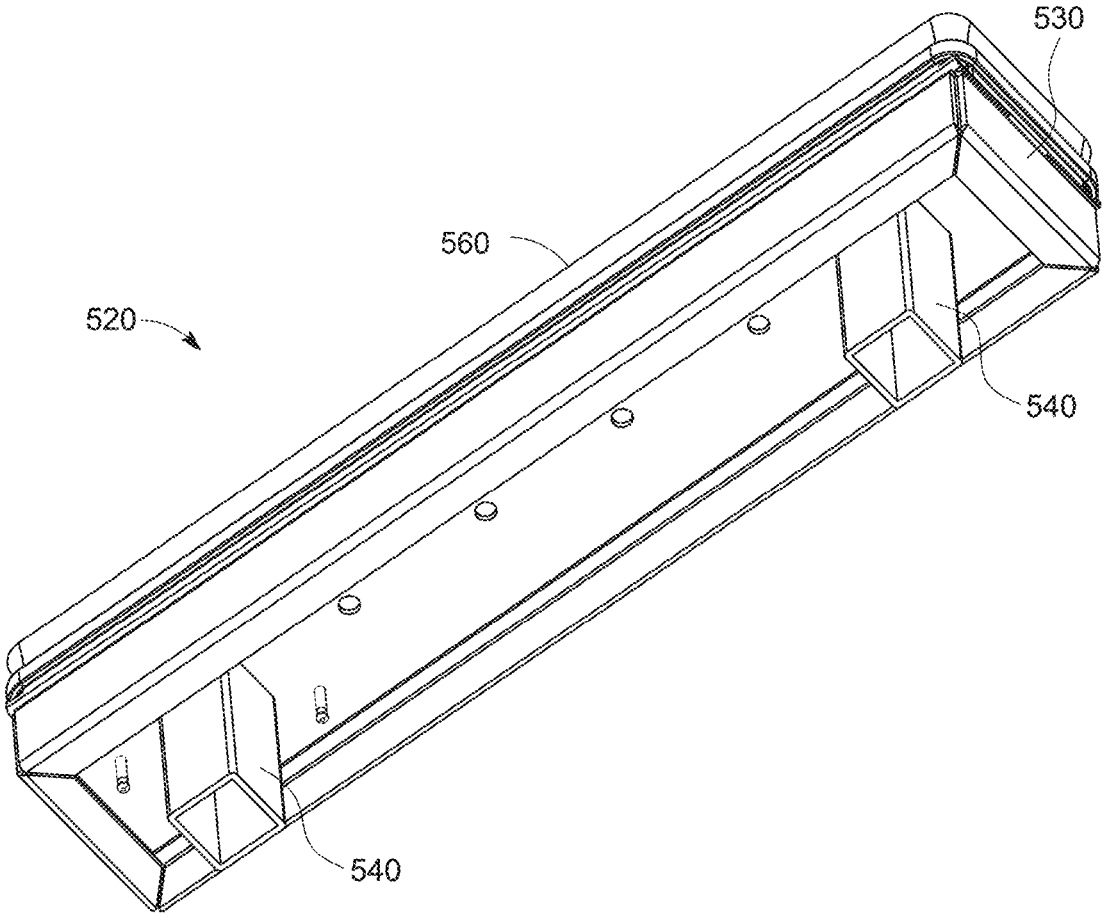
FIG. 22 is a bottom perspective view of the cover plug FIG. 21, according to an embodiment of the present disclosure.
Figure 23:
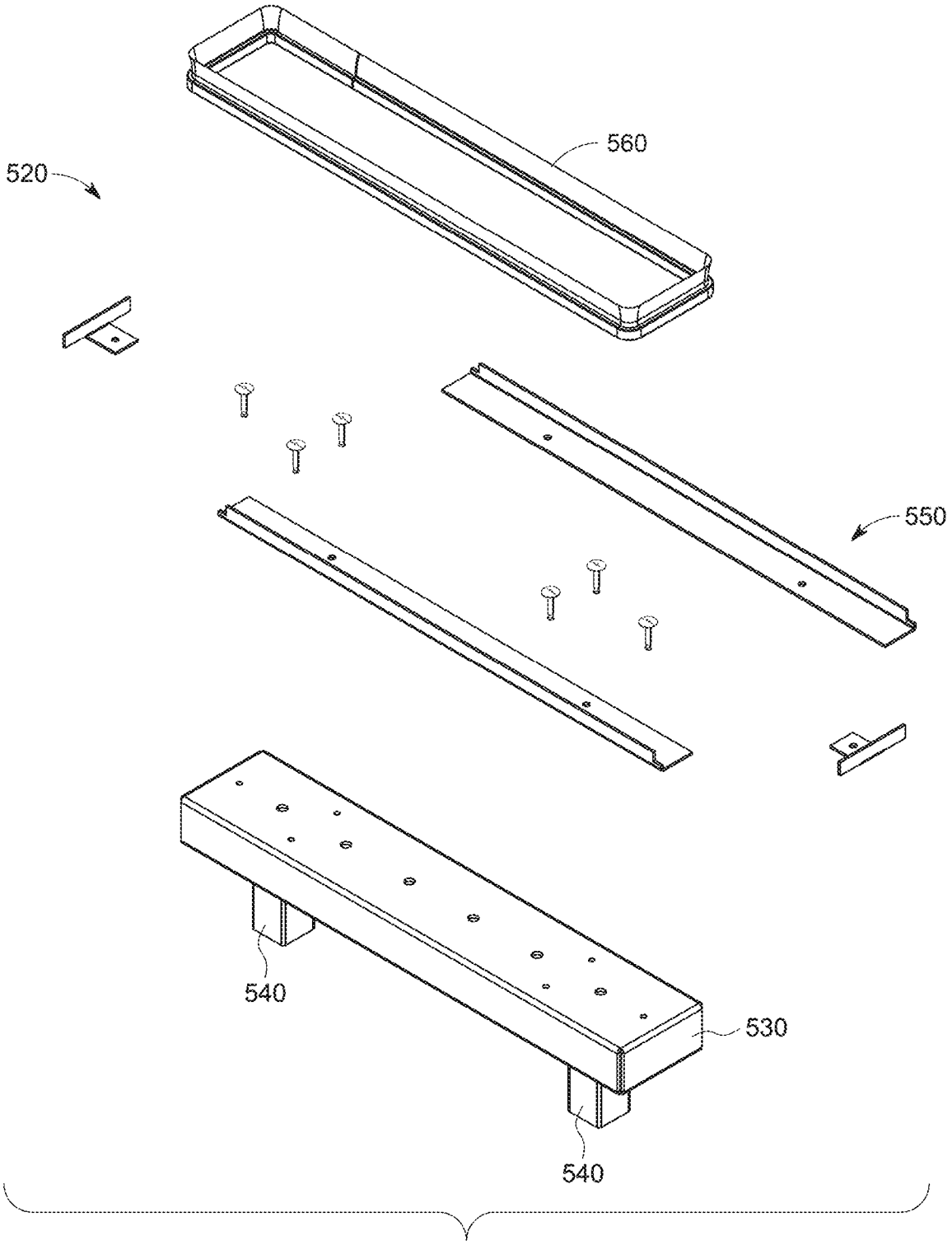
FIG. 23 is an exploded, top perspective view of the cover plug of FIG. 21, according to an embodiment of the present disclosure.
Figure 24:
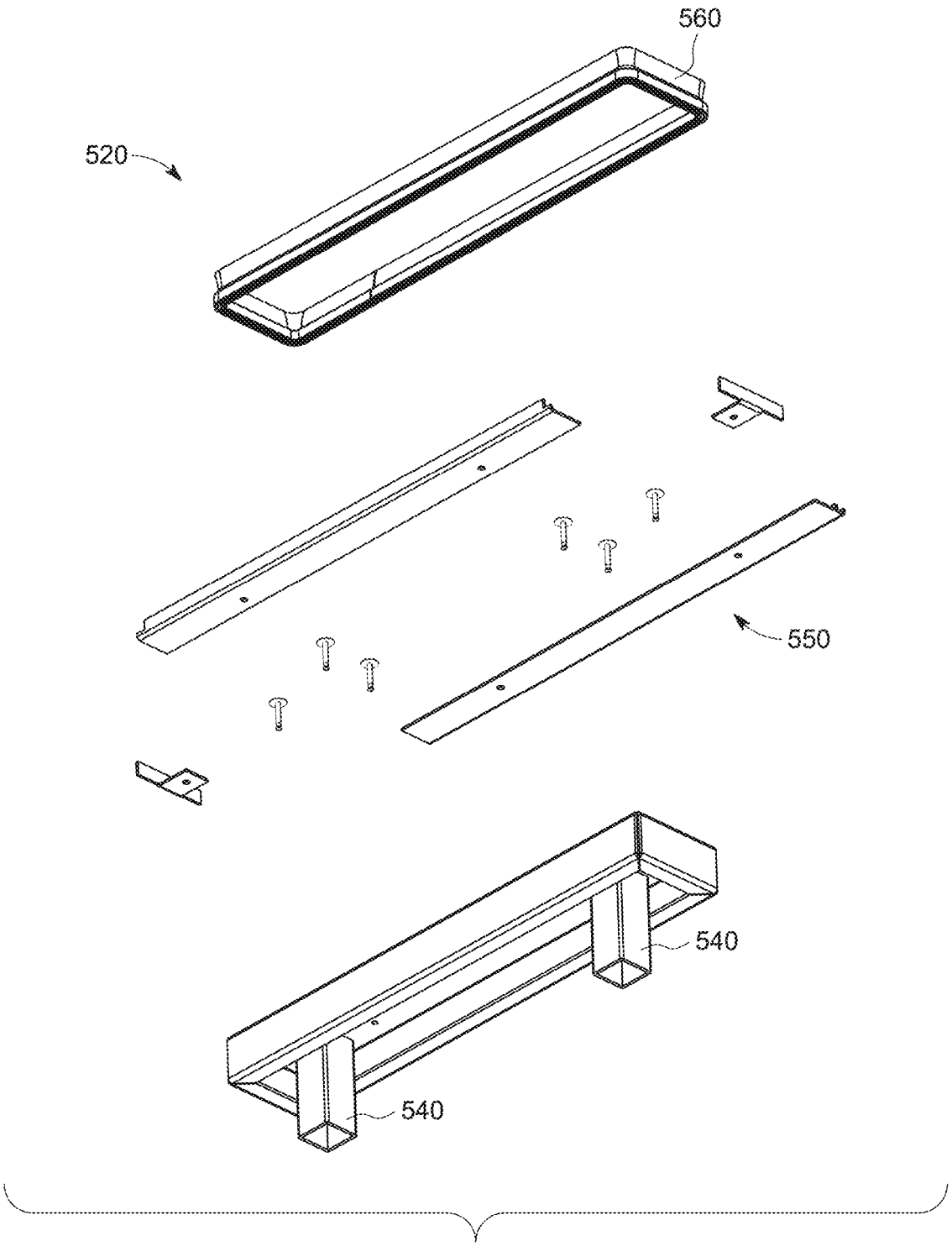
FIG. 24 is an exploded, bottom perspective view of the cover plug of FIG. 21, according to an embodiment of the present disclosure.
Figure 25:
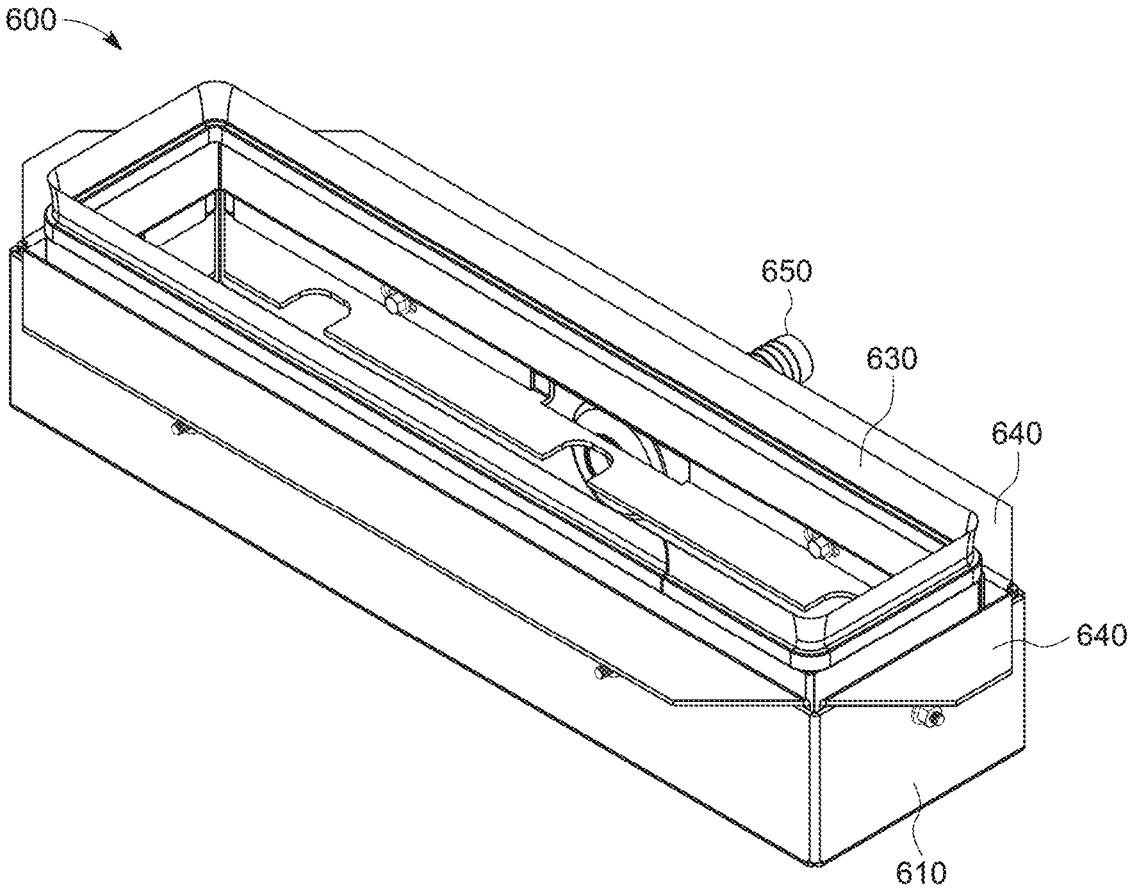
FIG. 25 is a top perspective view of the access frame of the anchor system of FIG. 18, according to an embodiment of the present disclosure.
Figure 26:
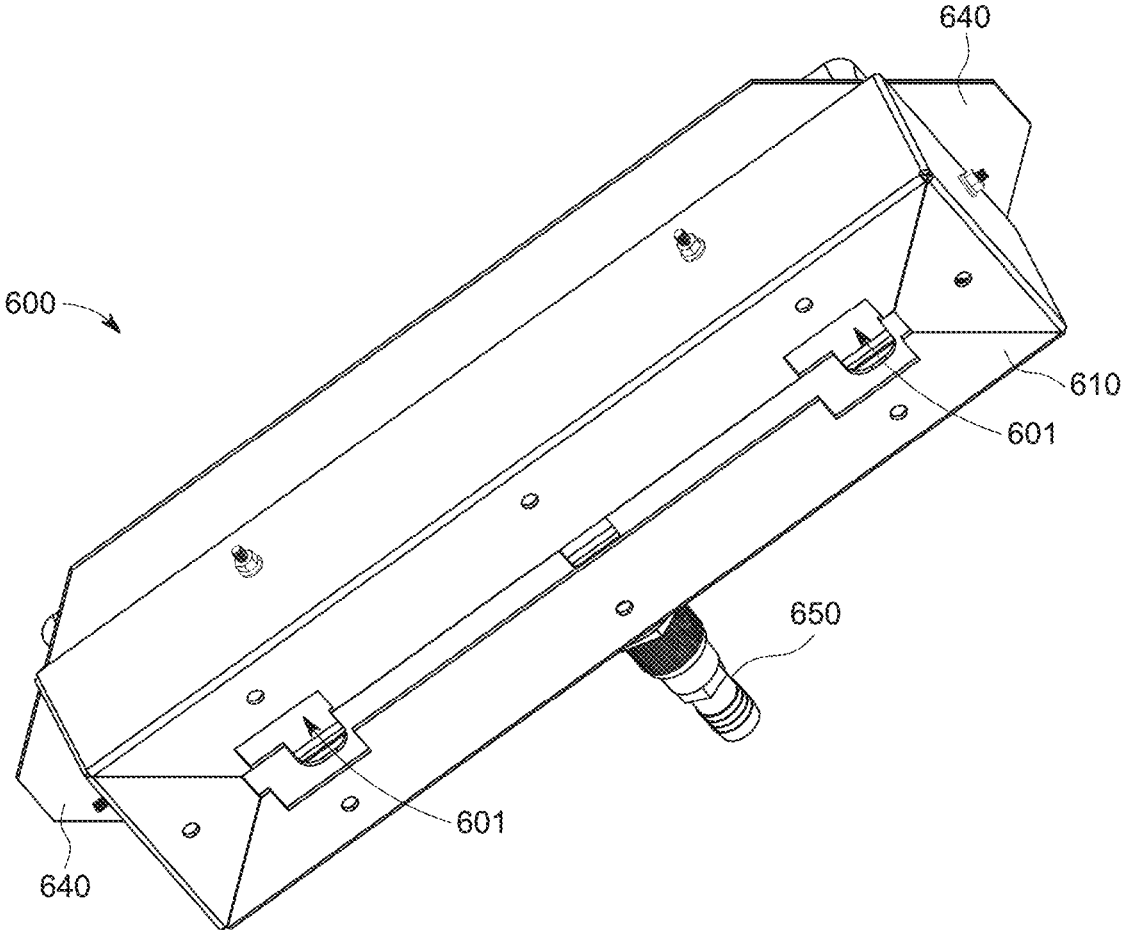
FIG. 26 is a bottom perspective view of the access frame of FIG. 25, according to an embodiment of the present disclosure.
Figure 27:
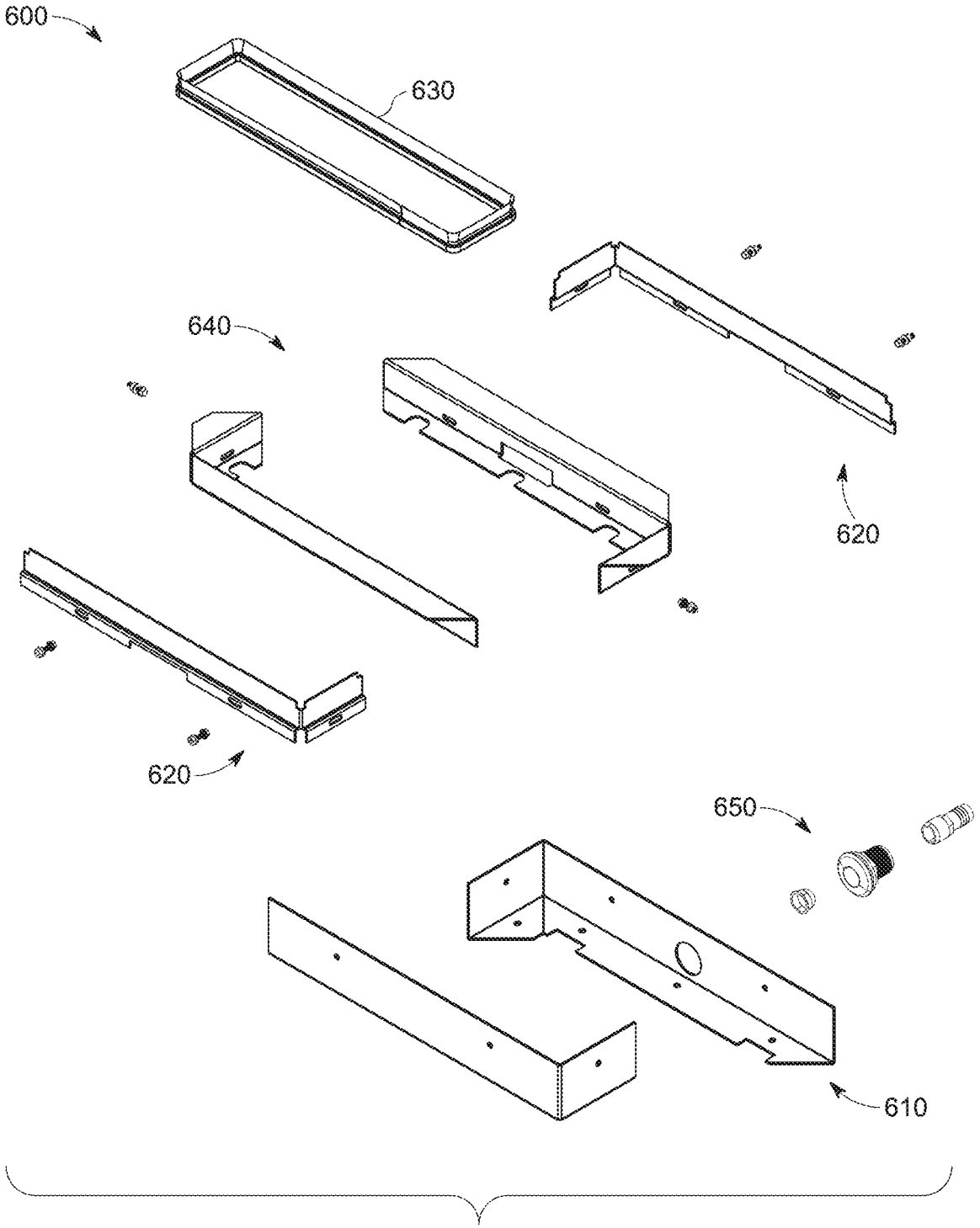
FIG. 27 is an exploded, top perspective view of the access frame of FIG. 21, according to an embodiment of the present disclosure.
Figure 28:
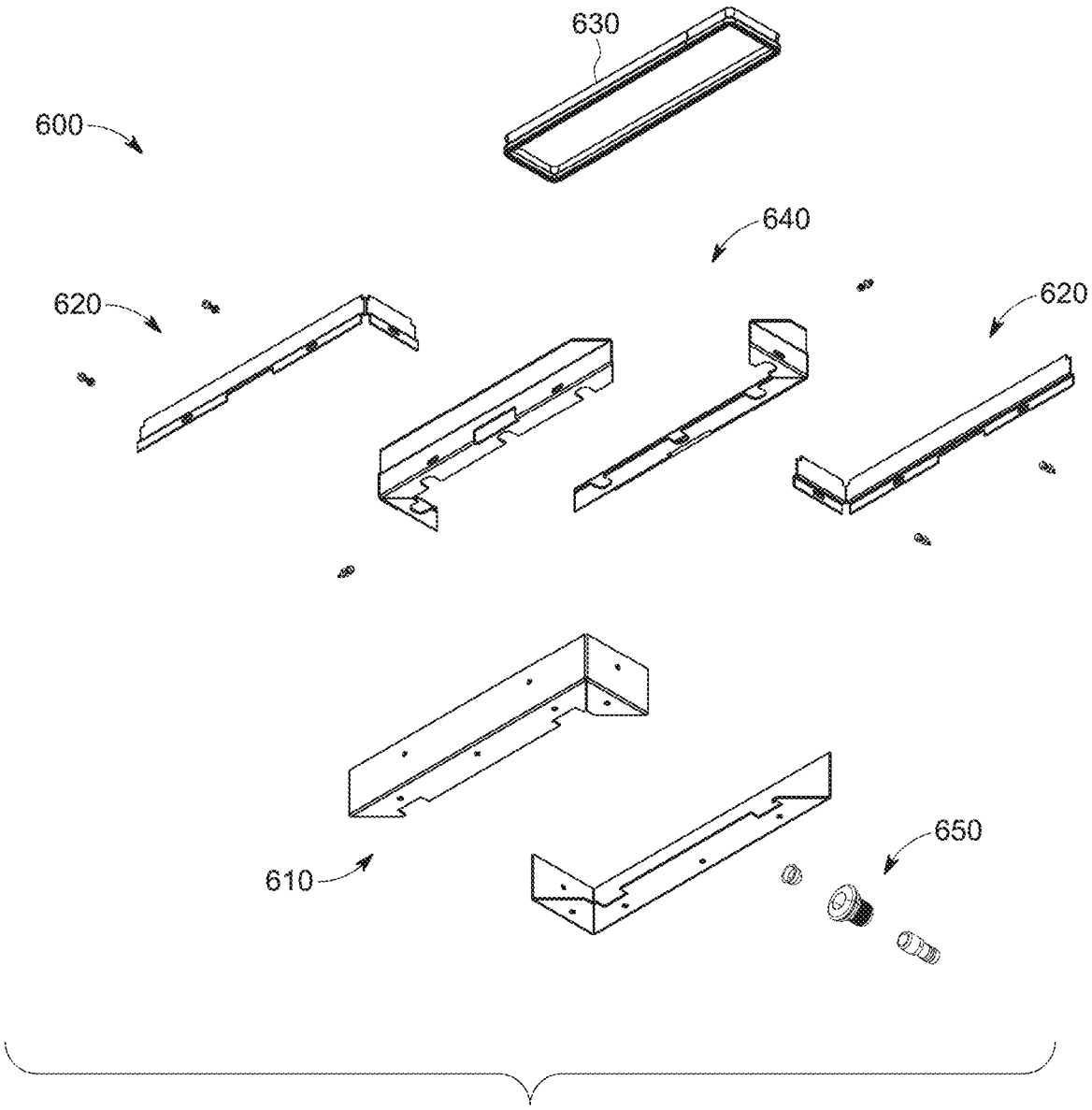
FIG. 28 is an exploded, bottom perspective view of the access frame of FIG. 27, according to an embodiment of the present disclosure.

FIGS. 18-20 illustrate an anchor system 500, which may be employed with a synthetic turf field, according to an embodiment of the present disclosure. For example, system 500 may be operable with a pitcher's rubber or a double base for playing baseball or softball, or for providing a level playing field. In this illustrated embodiment, system 500 may include a removable cover plug 520, and an access frame 600. In some embodiments, system 500 may include a base support 700 for fixedly securing the system in a support structure such as in a concrete footing in the ground. The base support 200 may include a pair of vertical members such as a pair of vertical hollow sleeves 720. Cover plug 520 with synthetic turf infill material (FIG. 20) is receivable in access frame 600 for providing a level playing field with the surrounding synthetic turf infill material such as for a field for playing soccer. With cover plug 520 removed, access frame 600 provides an anchor for receiving a pair of stanchions of a pitcher's rubber or a double base on the synthetic turf surface.

FIGS. 21-24 illustrate cover plug 520, according to an embodiment of the present disclosure. In this illustrated embodiment, cover plug 520 may include a body 530, a pair of spaced apart stanchions 540, a plurality of seal supports 550 (FIGS. 23 and 24), and a resilient or flexible seal 560. Cover plug 520 may be essentially the same as cover plug 20 (FIGS. 5 and 6) with the exception of being elongated or rectangular and including a pair of spaced apart stanchions.

As shown in FIGS. 25-28, access frame 600 may generally include a body 610, seal supports 620 (FIGS. 27 and 28), a resilient or flexible seal 630, a plurality of turf ledges 640, and a drain 650, according to an embodiment of the present disclosure. Access frame 600 may be essentially the same as access frame 100 (FIGS. 10 and 11) with the exception of being elongated or rectangular and including a pair of spaced apart opening 601 (FIG. 26) for receiving corresponding stanchions.

Figure 29:
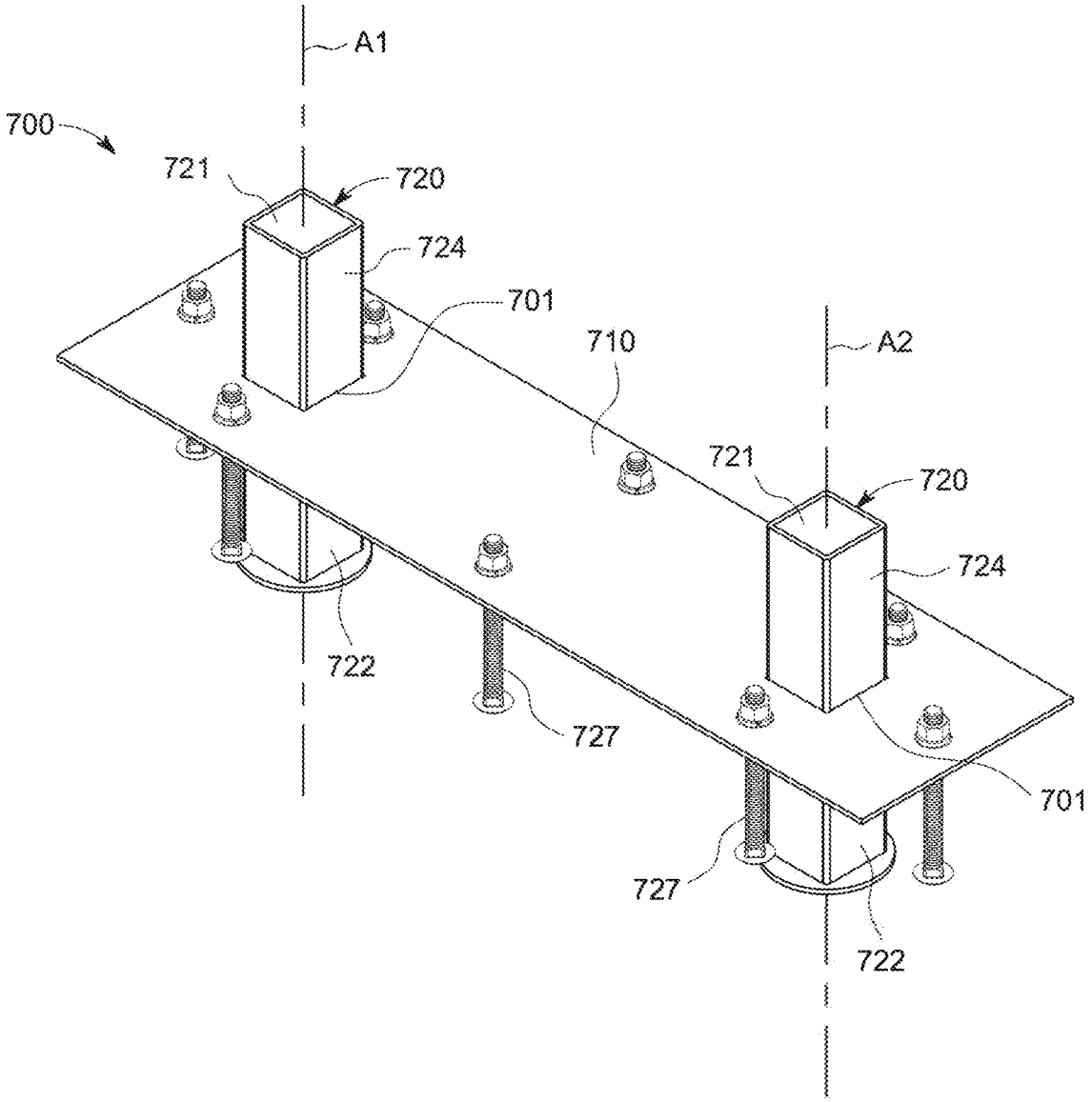
FIG. 29 is a perspective view of the base support of the frame assembly of FIG. 19, according to an embodiment of the present disclosure.

With reference to FIG. 29, base support 700 is operable for fixedly securing the system 500 (FIG. 18) in a support structure such as a concrete footing in the ground. Base support 700 may include a horizontal plate 710, having a plurality of openings sized for receiving hollow sleeves 720 such as a square tube having a passageway 721. Lower portions 722 of hollow sleeves 720 are disposed below plate 710 and upper portions 724 of hollow sleeves 720 are disposed above plate 710. Plate 710 may be disposed perpendicular to or at ninety degrees from an axis A1 and axis A2 of hollow sleeves 720. Base support 700 may be essentially the same as base support 200 (FIG. 13) with the exception of being elongated or rectangular and including a pair of spaced apart openings 701 for receiving corresponding hollow sleeves 720.

Figure 30:
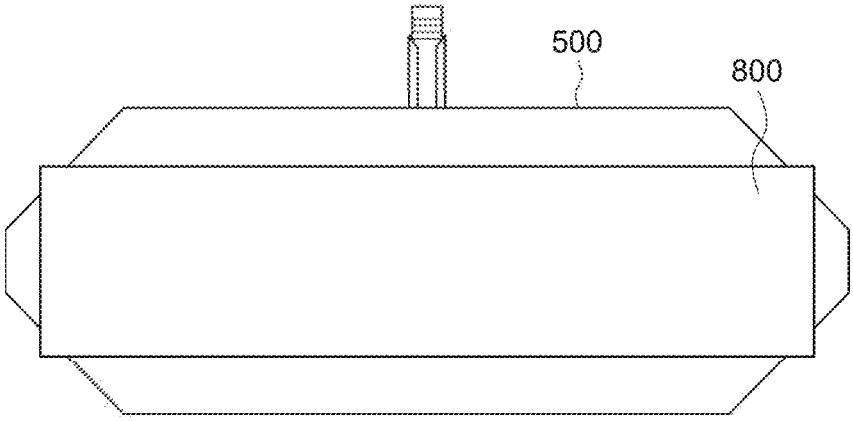
FIG. 30 is a top view of the anchor system of FIG. 18 and a pitcher's rubber, according to an embodiment of the present disclosure.
Figure 31:
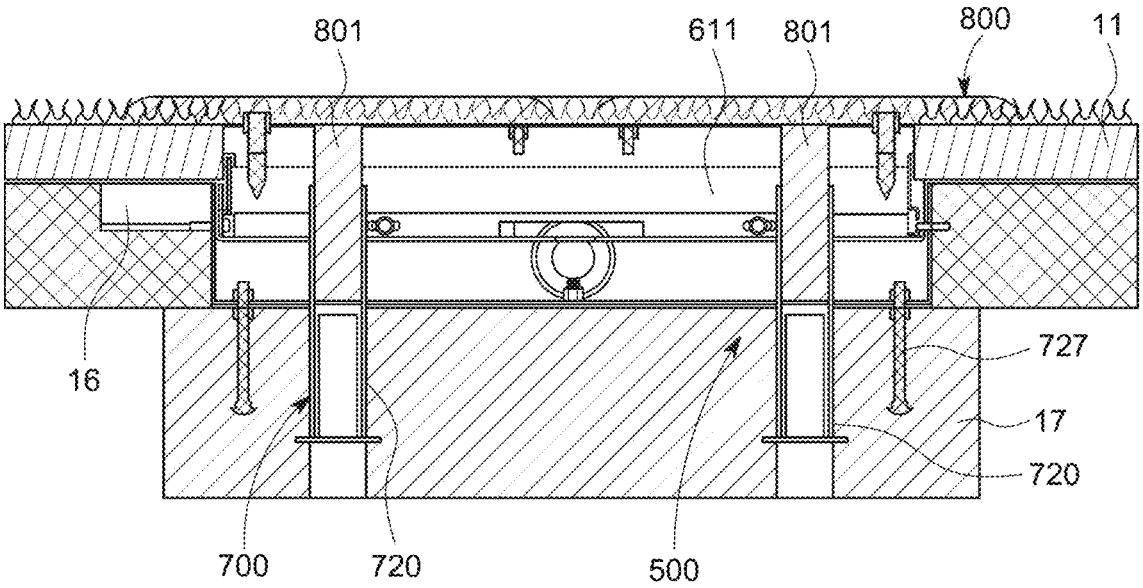
FIG. 31 is a cross-sectional view of the anchor system and the pitcher's rubber of FIG. 30, according to an embodiment of the present disclosure.

FIG. 30 illustrates a pitcher's rubber 800 positioned over and secured to system 500, according to an embodiment of the present disclosure. For example, pitcher's rubber 800 is inhibited from horizontal movement relative to the surface of synthetic turf field 11 (FIG. 31). As shown in FIG. 31, lower portions of stanchion 301 of pitcher's rubber 800 extend into cavity 611 of frame 500 and lower portions of stanchions 801 are disposed passageways 721 (FIG. 29) in hollow sleeves 720 of base support 700, e.g., passageways 721 (FIG. 29) is in fluid communication with cavity 611. The lower portions of base support 700, e.g., lower portions of hollow sleeves 720 and bolts 727 (FIG. 29) may be installed in a concrete footing 17 in the ground. An optional nailer board 16 may be provided around the access frame. With pitcher's rubber 800 removed, cover plug 520 (FIG. 20) having synthetic turf maybe reinstalled in the access frame 500.

Figure 32:
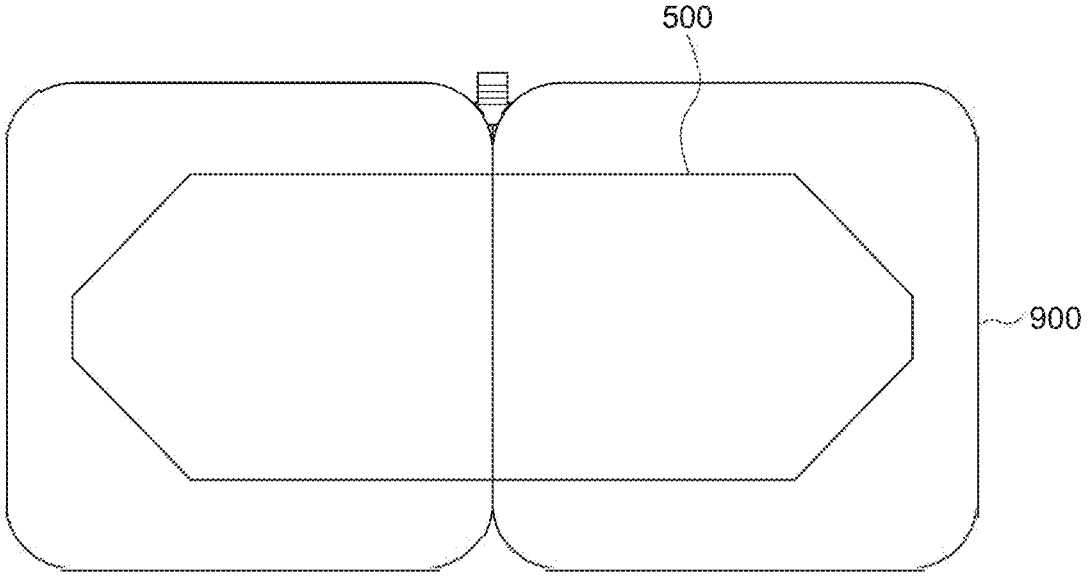
FIG. 32 is a top view of the anchor system and a double base of FIG. 18, according to an embodiment of the present disclosure.
Figure 33:
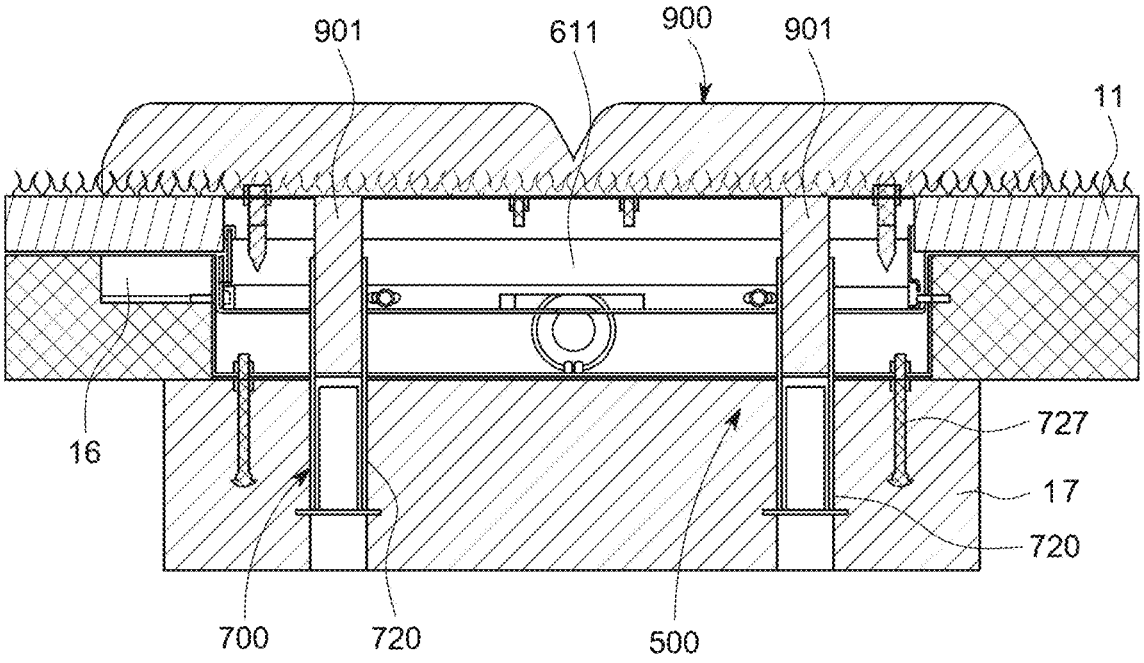
FIG. 33 is a cross-sectional view of the anchor system and the double base of FIG. 32, according to an embodiment of the present disclosure.

FIG. 32 illustrates a double base 900 positioned over and secured to anchor system 500, according to an embodiment of the present disclosure. For example, double base 900 is inhibited from horizontal movement relative to the surface of a synthetic field. As shown in FIG. 33, lower portions of stanchions 901 of double base 900 extend into cavity 611 of access frame 500 and lower portions of stanchions 901 are disposed in passageways 721 (FIG. 29) of hollow sleeves 720 of base support 700, e.g., passageways 721 (FIG. 29) is in fluid communication with cavity 611. The lower portions of base support 700, e.g., lower portions of hollow sleeves 720 and bolts 727 (FIG. 29) may be installed in a concrete footing 17 disposed in the ground. An optional nailer board 16 may be provided around the access frame. With double base 900 removed, cover plug 520 (FIG. 20) having synthetic turf maybe reinstalled in the access frame 500.

In the various embodiments, the portions of the access frame and removable cover plugs may be formed from a metal material such as aluminum. For example, the body of the half sections of the access frame may be formed form ⅛ inch thick aluminum. The drain of the access frame may be a 1 inch PVC Drain Stub for positive connection to a subsurface drainage system. The flexible seals or flexible seals may have a height of 1¼ inch. The drainage holes in the platform of the cover plug may be ⅜ inch perforated drainage holes. The anchor bolts of the base support may be ⅜-16×4 inch stainless steel carriage bolts.

The access frame for the bases and home plate may be about 8 inches square and about 4 inches high. The height of the bottom of the vertical hollow sleeve to the top of the flexible seals may be about 10 inches. The top of the ledge of the access frame to the top of the flexible seals may be about 1⅝ inches. The removable flexible seal of the cover plug may define an opening of about 6 inches square. The ground for receiving the anchor system may be excavated to a minimum of about 12 inches in diameter and about 10 inches deep. The concrete foundation may be about 12 inches in diameter and 5½ inches deep. For example, the concrete foundation may be poured up to an elevation of 5¾ inches below finish grade and set anchor base support it the wet or uncured concrete so that the base plate is at the 5¾ inch level. Once the concrete is cured, the nuts are removed from the anchor bolts. After installing the access frame onto the anchor bolts, the nuts can be replaced. The synthetic infill turf can be cut and secured to the provided infill turf attachment ledge and cover plug. The stanchion support tube, or support block, or spacer is inserted onto the anchor tube or vertical hollow sleeve to support the stanchion of the base or home plate. The single base or home plate can be test fit and the spacer or the infill height can be adjusted. The replacement cover plug can be inserted when the single base or home plate is not in use.

The access frame for the pitcher's rubber and the double base may be about 23 inches wide, about 6 inches deep, and about 4 inches high. The height of the bottom of the vertical hollow sleeve to the top of the flexible seals may be about 10 inches. The top of the ledge of the access frame to the top of the flexible seals may be about 1⅝ inches. The removable flexible seal of the cover plug may define an opening about 21 inches and 4 inches. The ground for receiving the anchor system may be excavated to a minimum of about 26 inches in diameter and about 10 inches deep. The concrete foundation may be about 26 inches in diameter and 6 inches deep. For example, the concrete foundation may be poured up to an elevation of 5¾ inches below finish grade and set anchor base support it the wet or uncured concrete so that the base plate is at the 5¾ inch level. Once the concrete is cured, the nuts are removed from the anchor bolts. After installing the access frame onto the anchor bolts, the nuts can be replaced. The synthetic infill turf can be cut and secured to the provided infill turf attachment ledge and cover plug. The stanchion support tube, or support block, or spacer is inserted onto the anchor tube or vertical hollow sleeve to support the stanchion of the base or home plate. The pitcher's rubber or double base can be test fit and the spacer or the infill height can be adjusted. The replacement cover plug can be inserted when the pitcher's rubber or double base is not in use.

Figure 34:
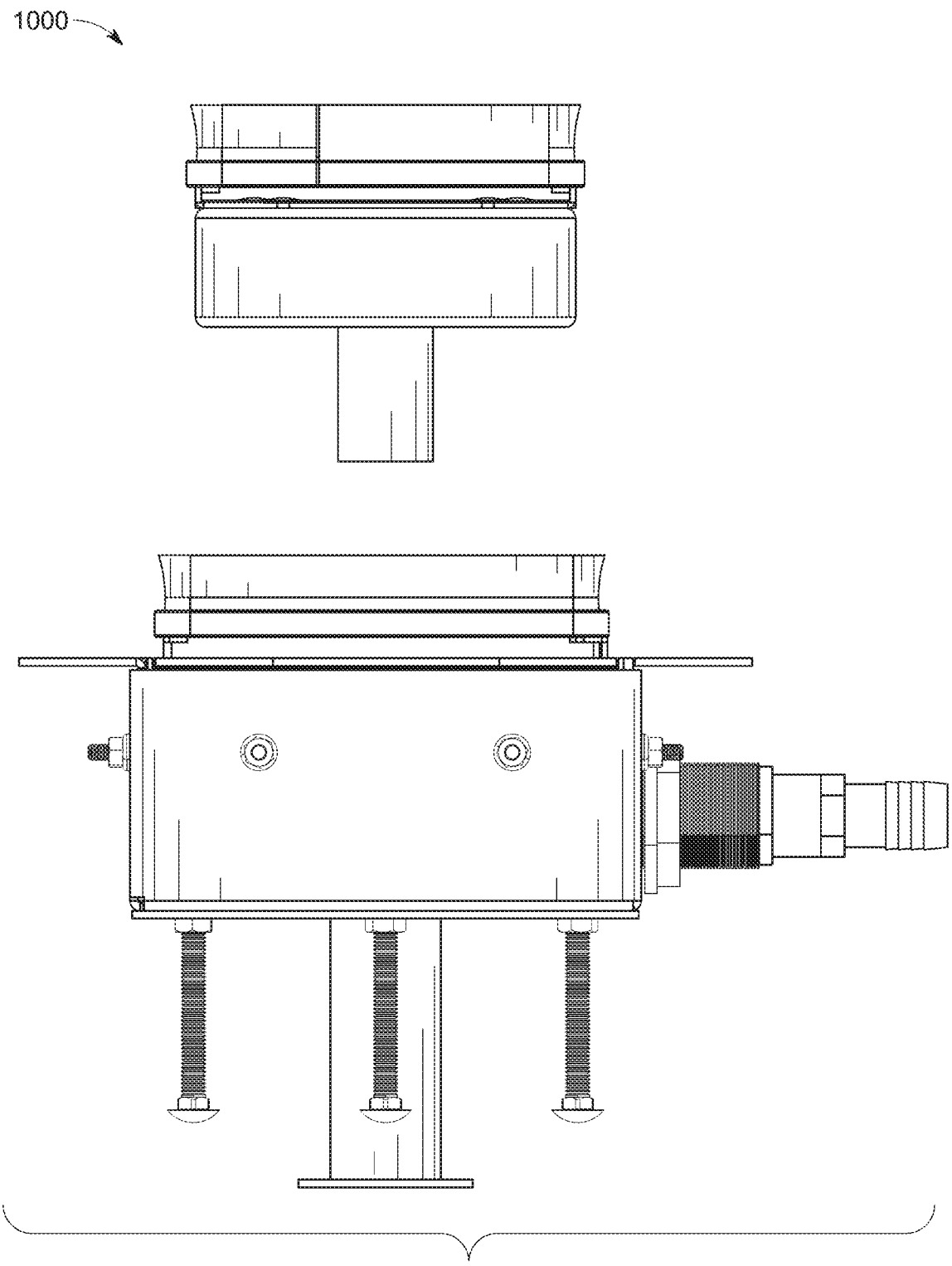
FIG. 34 is an exploded, side elevational view of another anchor system, according to an embodiment of the present disclosure.

FIG. 34 illustrates another anchor system 1000 for supporting bases, home plates, pitcher's rubbers, and double bases for playing baseball and softball, while also allowing use of the synthetic turf field as a level synthetic turf field, according to an embodiment of the present disclosure. In this illustrated embodiment, the elements forming the system 1000 may have a round cylindrical configuration.

FIGS. 35-40 illustrate further anchor systems 1100, 1200, and 1300 for supporting bases, home plates, pitcher's rubbers, and double bases for playing baseball and softball and for supporting other components for other purposes, while also allowing use of the synthetic turf field as a level synthetic turf field, according to an embodiment of the present disclosure. In these illustrated embodiments, the elements forming the systems 1100 and 1200 may include features similar to the above description anchor systems, and may have a round cylindrical configuration.

Figure 35:
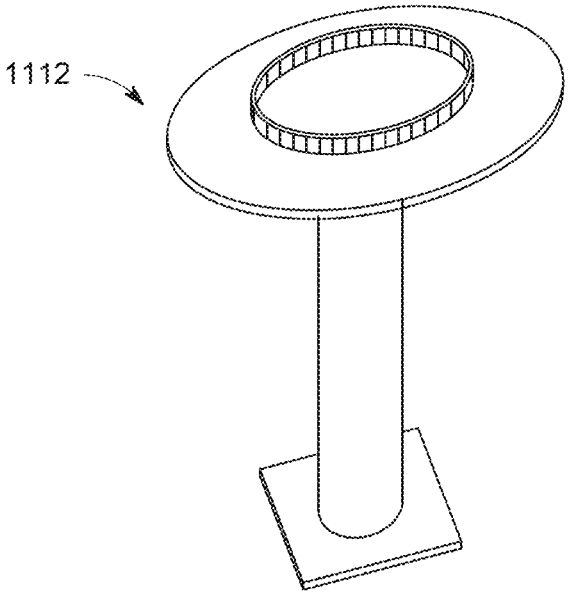
FIGS. 35 and 36 are perspective and cross-sectional views of another anchor system, according to an embodiment of the present disclosure.
Figure 36:
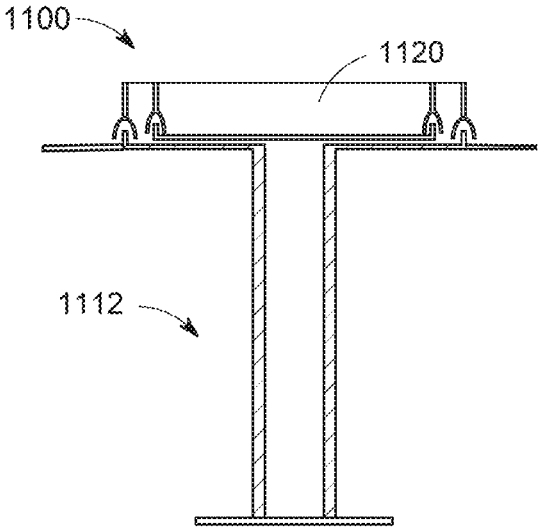
Figure 37:
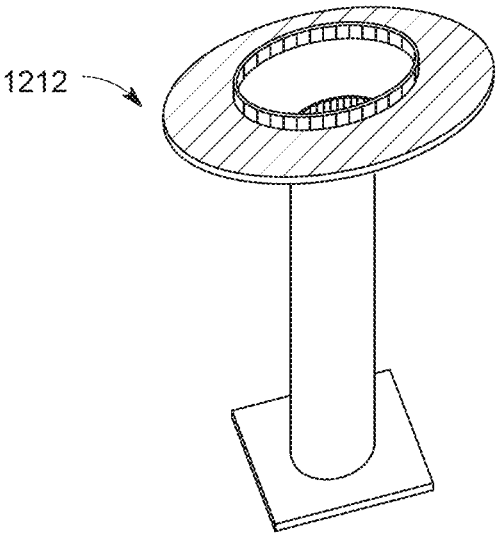
FIGS. 37 and 38 are perspective and cross-sectional views of another anchor system, according to an embodiment of the present disclosure.
Figure 38:
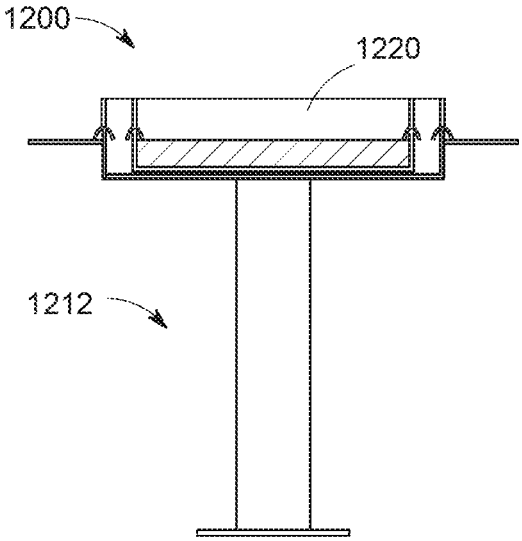
Figure 39:
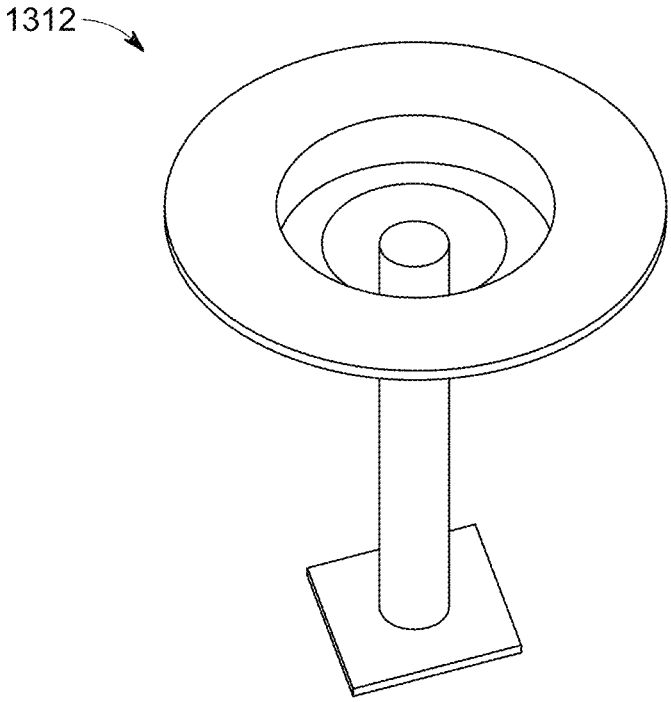
FIGS. 39 and 40 are perspective and cross-sectional views of another anchor system, according to an embodiment of the present disclosure.
Figure 40:
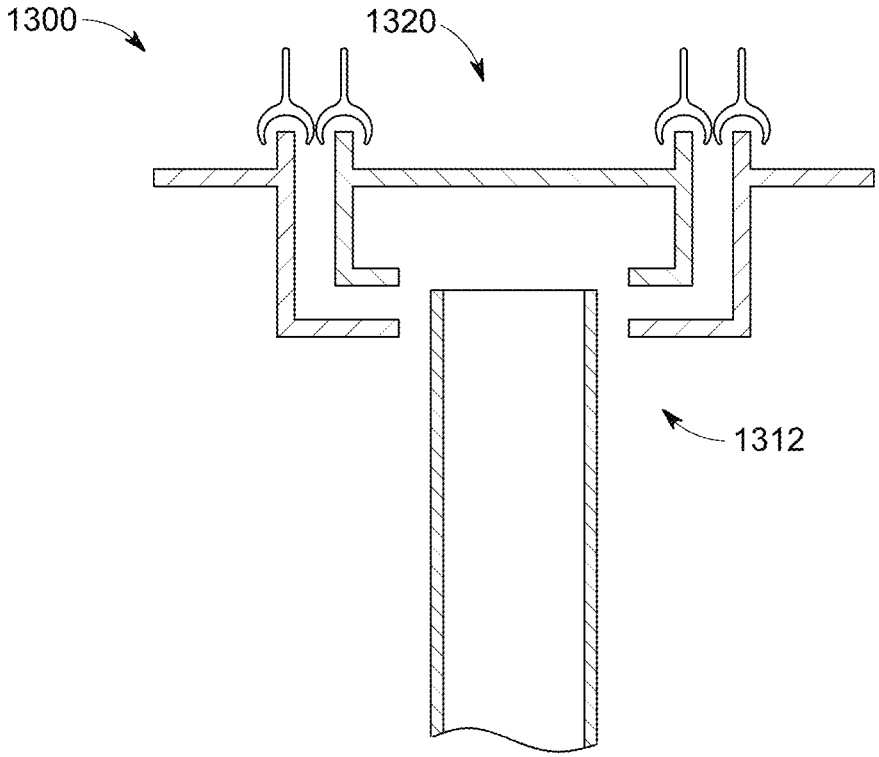

With reference to FIGS. 35 and 36, for example, system 1100 (FIG. 35) may include a removable cover plug 1120 (FIG. 36), and a frame assembly 1112 (a portion of which is shown in FIG. 35). With reference to FIGS. 37 and 38, for example, system 1200 (FIG. 37) may include a removable cover plug 1220 (FIG. 38), and a frame assembly 1212 (a portion of which is shown in FIG. 35). With reference to FIGS. 39 and 40, for example, system 1300 (FIG. 39) may include a removable cover plug 1320 (FIG. 40), and a frame assembly 1312 (a portion of which is shown in FIG. 39).

Figure 41:
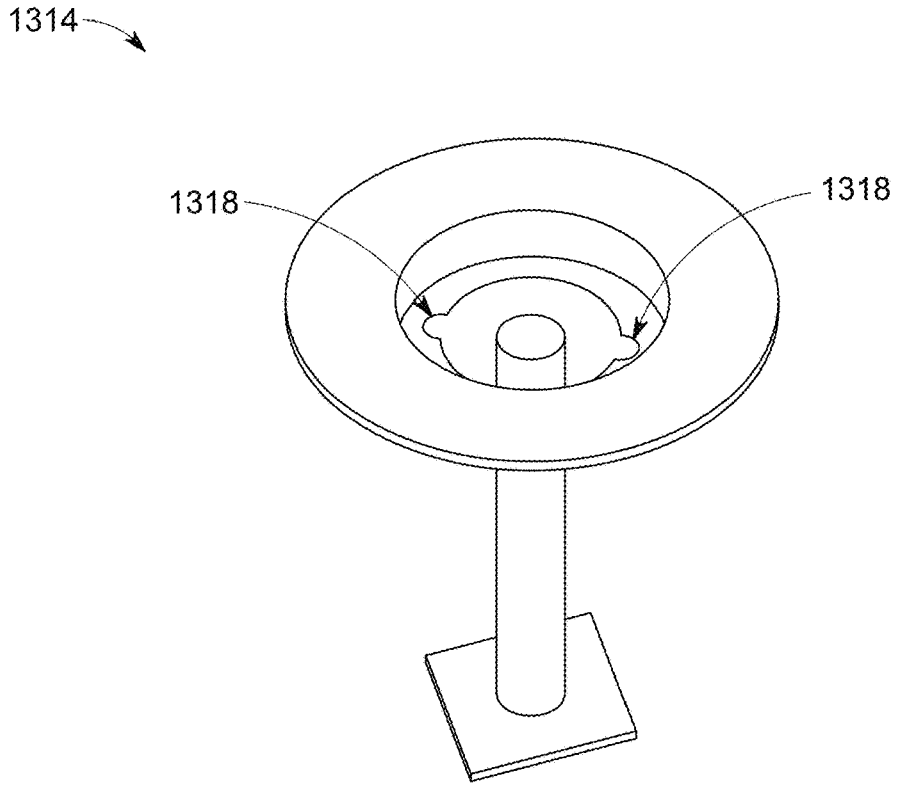
FIGS. 41 and 42 are perspective and cross-sectional views of another anchor system, according to an embodiment of the present disclosure.
Figure 42:
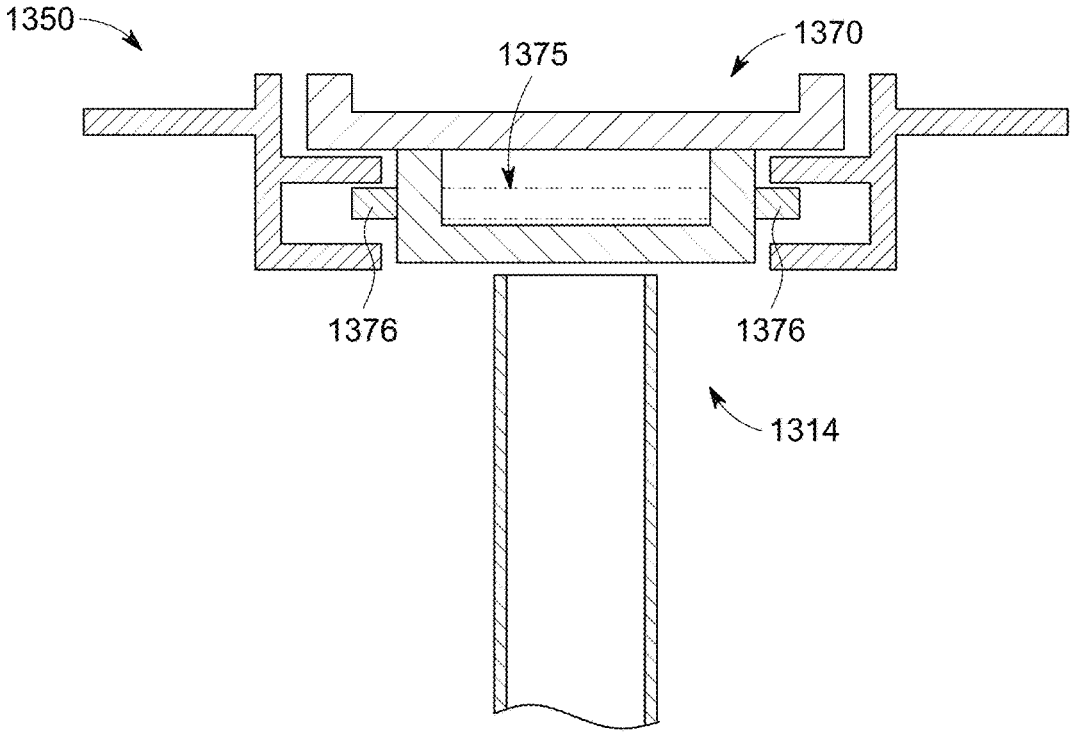

With reference to FIGS. 39 and 40, an anchor system 1350 (FIG. 42) may include a removable cover plug 1370 (FIG. 42), and a frame assembly 1314 (a portion of which is shown in FIG. 41), according to an embodiment of the present disclosure. In this illustrated embodiment, cover plug 1370 is operably lockable to frame assembly 1314. For example, frame assembly 1314 may include a pair of cutouts or notches 1318 (FIG. 41) in the ledge that the cover plug 1370 (FIG. 42) rest or sits on. Cover plug 1370 (FIG. 42) may include a rod 1375 (FIG. 42) having ends 1376 (FIG. 42) positioned to be received in the cutouts or notches 1318 (FIG. 41) in the ledge of the cover plug 1370 (FIG. 42). The ends 1376 (FIG. 42) are operable to mate with the notches of the ledge, such that they may be aligned to insert/remove the cover plug. The cover plug can be secured with a quarter turn or any amount of rotation to create a misalignment to prevent the cover plug from being lifted out of the frame assembly. The above anchor systems may include appropriate flexible seals. The above releasably locking feature or other releasably locking features may be employed in connection with the above-described anchor systems.

It will be appreciated that the technique of the present disclosure may be operable for supporting bases, home plates, pitcher's rubbers, and double bases for playing baseball and softball, as well as supporting other types of sports related and non-sport related components or devices on a synthetic turf field, while also allowing a use of the synthetic turf field as a level synthetic turf field when the components or devices are not required.

As an example, the technique of the present disclosure may be applicable for use with one or more of the above access frames with other components such as for playing frisbee golf or disc golf on a field or on a synthetic field, according to embodiments of the present disclosure. For example, a frame system may include a frame assembly and cover plug. The cover plug may be removed, and an elongated member or central pole of a standard frisbee golf or disc golf basket may be inserted and supported in the vertical hollow sleeve of the frame assembly. The baskets may be constructed with a central pole holding a basket under an assembly of hanging chains. When a disc hits the chains, it is often, but not always, deflected into the basket. In other embodiments, flags poles, sign poles, or other devices may be supported in the anchor system. The anchor systems may have more than two vertical hollow sleeves for supporting a multiplicity of components.

From the present disclosure, it will be appreciated that the at least one vertical member of the frame assembly may be disposed so that a lower portion of the vertical member is disposed below the bottom of the access frame and an upper portion of the of the vertical member disposed in the cavity. In other embodiments, the at least one vertical member may be disposed entirely within the cavity of the access frame. In still other embodiments, the entire at least one vertical member may be disposed below or extend from the bottom of the access frame. In the various embodiments, at least one vertical member may be hollow for receiving a stanchion therein, or the at least one vertical member may be solid or having a closed end and a hollow stanchion may engage and be disposed over the solid or closed end vertical member.

Figure 43:
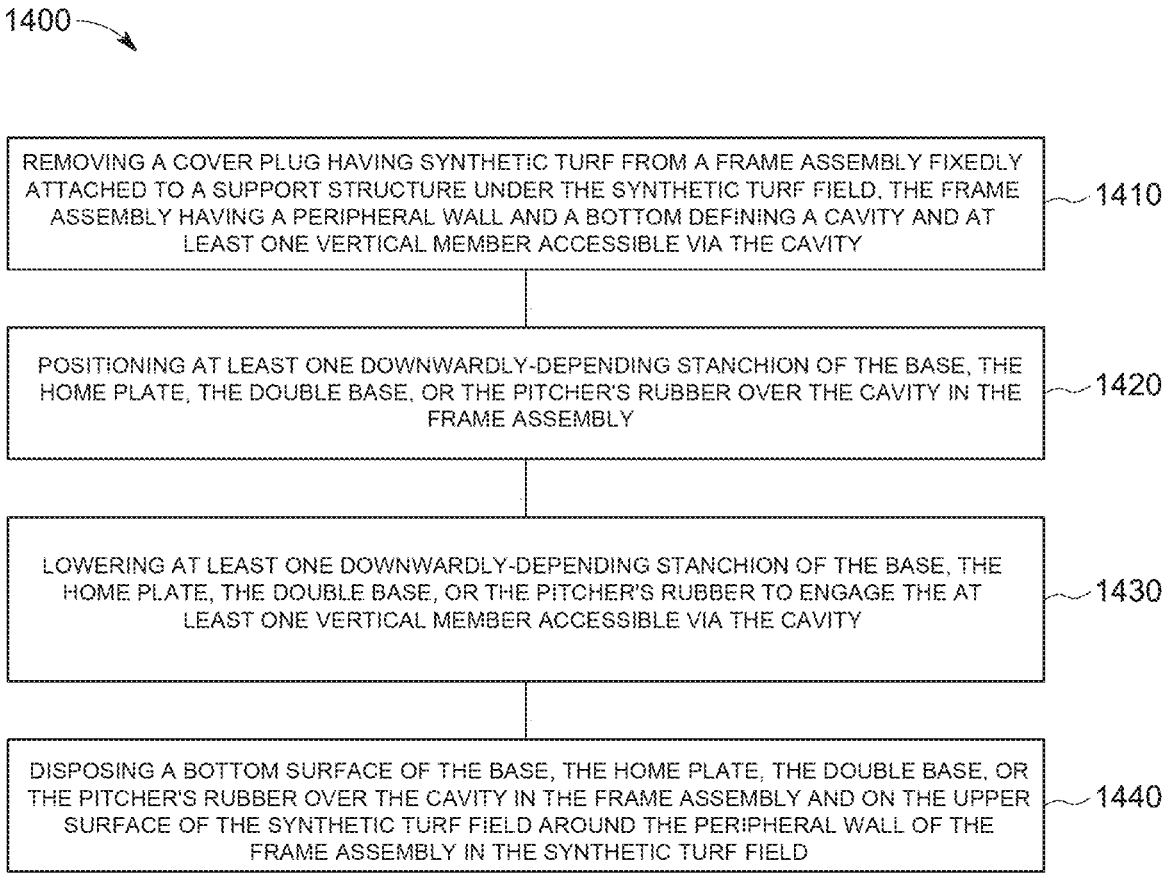
FIG. 43 is a flowchart of a method for releasably restraining a base, a home plate, a double base, or a pitcher's rubber on a surface of synthetic turf, according to an embodiment of the present disclosure.

FIG. 43 illustrates a method 1400 for releasably restraining a base, a home plate, a double base, or a pitcher's rubber on an upper surface of synthetic turf field, according to an embodiment of the present disclosure. The method 1400 may include, for example, at 1410 removing a cover plug having synthetic turf from a frame assembly fixedly attached to a support structure under the synthetic turf field, the frame assembly having a peripheral wall and a bottom defining a cavity and at least one vertical member accessible via the cavity, at 1420 positioning at least one downwardly-depending stanchion of the base, the home plate, the double base, or the pitcher's rubber over the cavity in the frame assembly, at 1430 lowering at least one downwardly-depending stanchion of the base, the home plate, the double base, or the pitcher's rubber to engage the at least one vertical member accessible via the cavity, and at 1440 disposing a bottom surface of the base, the home plate, the double base, or the pitcher's rubber over the cavity in the frame assembly and on the upper surface of the synthetic turf field around the peripheral wall of the frame assembly in the synthetic turf field.

Figure 44:
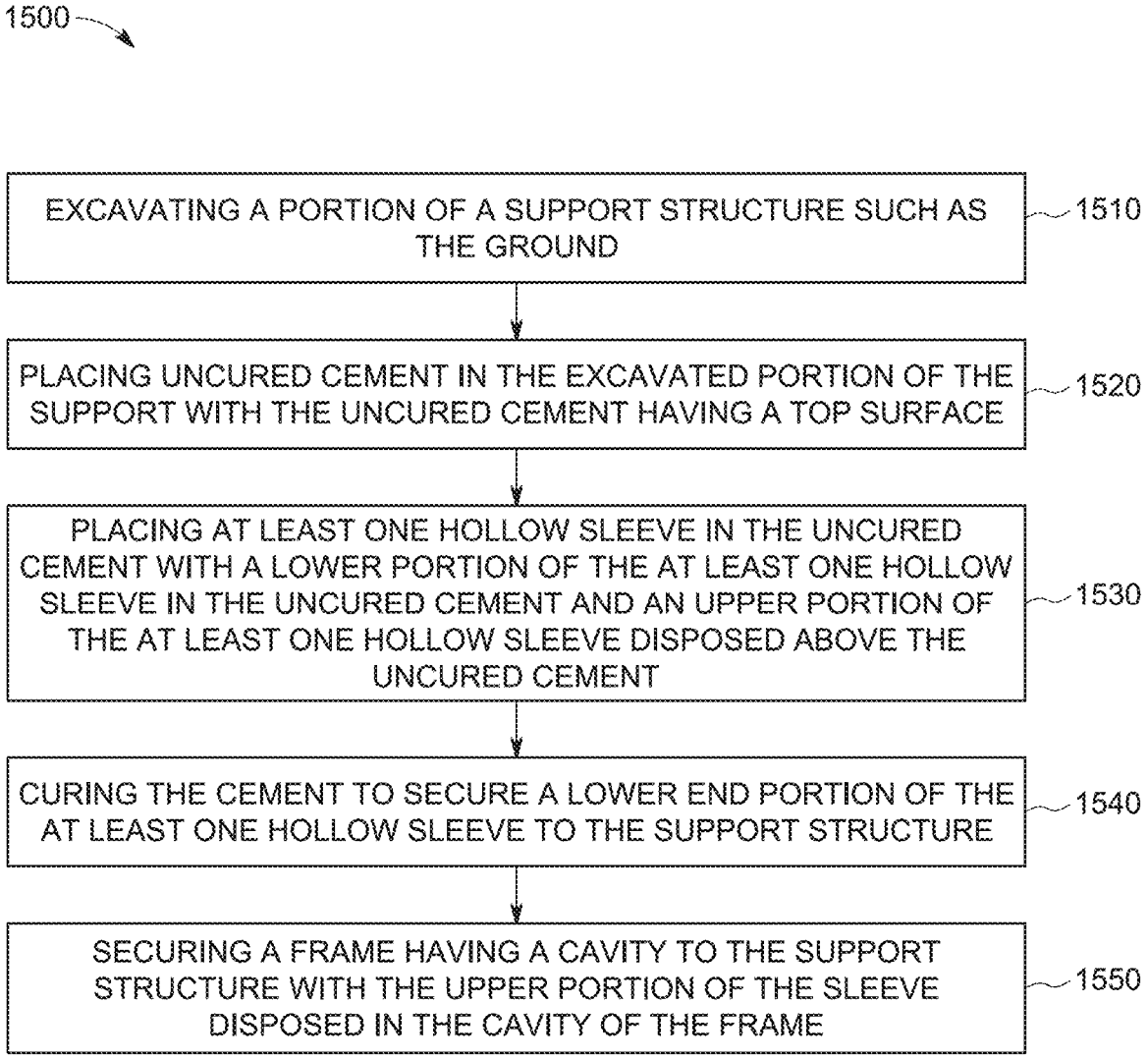
FIG. 44 is a flowchart of a method for forming an anchor system for releasably restraining a base, a home plate, a double base, or a pitcher's rubber on a surface of synthetic turf, according to an embodiment of the present disclosure.

FIG. 44 illustrates a method 1500 for forming an anchor system for releasably restraining a base, a home plate, a double base, or a pitcher's rubber on a surface of synthetic turf, according to an embodiment of the present disclosure. The method 1500 may include, for example, at 1510 excavating a portion of a support structure such as the ground, at 1520 placing uncured cement in the excavated portion of the support structure with the uncured cement having a top surface, at 1530 placing at least one hollow sleeve in the uncured cement with a lower portion of the at least one hollow sleeve in the uncured cement and an upper portion of the at least one hollow sleeve disposed above the uncured cement, at 1540 curing the cement to secure a lower end portion of the at least one hollow sleeve to the support structure, and at 1550 securing a frame having a cavity to the support structure with the upper portion of the sleeve disposed in the cavity of the frame.

The method may include the frame includes a horizontally outwardly-extending member, and further include placing a sub-base material around the frame between the horizontally outwardly-extending member and support structure, and installing synthetic turf around the frame and on the horizontally outwardly-extending member. A horizontal member such as a planar member, having a top surface, a bottom surface, and at least one through-opening extending from the top surface to the bottom surface, may be placed so that the bottom surface of the horizontal member rests on the uncured concrete with the at least one through-opening disposed around the at least one sleeve.

The method may further include positioning a cover plug in the cavity of the frame, positioning a piece of the synthetic turf along a top surface of the plug, and positioning a stanchion downwardly-depending from the cover plug in the sleeve. The method may include inhibiting material from the synthetic turf from falling into the frame via a flexible seal extending vertically from and along a top periphery of the frame.

Another method for forming an anchor system for releasably restraining a base, a home plate, a double base, or a pitcher's rubber on a surface of synthetic turf, according to an embodiment of the present disclosure, may include for example, excavating a portion of a support structure, securing an access frame to cement disposed in the excavated portion of the support structure, the access frame having a cavity and a vertical hollow sleeve having a passageway in fluid communication with the cavity, installing synthetic turf around the cavity of the access frame, and installing a cover plug having synthetic turf in the cavity.

A1. A method for releasably restraining a component or device from a synthetic turf field, the method comprising: removing a cover plug having synthetic turf from a frame assembly fixedly attached to a support structure under the synthetic turf field, the frame assembly having a peripheral wall and a bottom defining a cavity and at least one vertical member accessible via the cavity; positioning at least one elongated member of the component over the cavity in the frame assembly; lowering at least one elongated member of the component to engage the at least one vertical member accessible via the cavity. A2. The method of A1 wherein: the at least one vertical member comprises a single vertical member; the at least one elongated member of the component comprises a single elongated member of the component; the positioning comprises positioning the single elongated member of the component over the cavity in the frame assembly; the lowering comprises lowering the single elongated member of the component to engage the at least one vertical member accessible via the cavity. A3. The method of A2 wherein: the single vertical member comprises an upper portion that extends into the cavity of the frame assembly. A4. The method of A2 wherein: the single vertical member comprises a lower portion that extends below a bottom of the frame assembly. A5. The method of A2 wherein: the single vertical member is aligned with a center of the peripheral wall. A6. The method of A2 wherein: the vertical member comprises a single vertical hollow sleeve accessible via the cavity; and the engaging comprises inserting the at least one elongated member of the component between the peripheral wall of the frame assembly and in a passageway in the single vertical hollow sleeve accessible via the cavity. A7. The method of A6 further comprising: placing a stanchion support in the passageway of the single vertical hollow sleeve for supporting and leveling the elongated member of the component. A8. The method of A6 wherein: the cover plug comprises a single downwardly-depending stanchion; and the removing comprises removing the single downwardly-depending stanchion of the cover plug from the passageway in the single vertical hollow sleeve. A9. The method of A2 further comprising: removing the elongated member of the component from the access frame; reinstalling the cover plug having synthetic turf in the cavity; and aligning a first flexible seal disposed around the synthetic turf of the cover plug adjacent to a second flexible seal disposed around the cavity.

B1. An anchor system attachable to a support structure for securing a component or device from a synthetic turf field, said anchor system comprising: a frame assembly comprising: an access frame having a bottom and a wall defining an upper opening and a cavity therein; a first flexible seal extending above said upper opening of said wall of said access frame; at least one vertical member accessible via the cavity; a removable cover plug for supporting synthetic turf; and wherein said frame assembly being fixedly attachable to the support structure under the synthetic turf, and said cover plug operable for covering the cavity in the access frame; and wherein when said cover plug is removed, an elongated member of the component or device is disposable over said upper opening of said access frame and engageable with said at least one vertical member for supporting the component or device from the synthetic turf field. B2. The anchor system of B1 wherein said at least one vertical member comprise a vertical hollow sleeve that extends below said bottom of said access frame, and said at least one vertical hollow sleeve comprises a closed lower end disposable in the support structure. B3. The anchor system of B2 wherein said at least one vertical hollow sleeve comprises a cap extending across said passageways of said vertical hollow sleeve to form a closed lower end of said vertical hollow sleeve, and said cap extending laterally outward from said vertical hollow sleeve. B4. The anchor system of B2 wherein said at least one vertical hollow sleeve comprises an upper portion disposed in said cavity of said access frame. B5. The anchor system of B2 further comprising at least one leveling stanchion support disposable in said passageway of said at least one vertical hollow sleeve for supporting the elongated member of the component or device. B6. The anchor system of B1 wherein said frame assembly further comprises a horizontal plate secured to and disposed around said at least one vertical member to define a support for fixedly securing the anchor system in the support structure. B7. The anchor system of B6 further comprising a plurality of bolts extending through said horizontal plate, lower portions of said plurality of bolts being disposable below said horizontal plate and fixedly securable in the support structure, and upper portions of said plurality of bolts disposable above said horizontal plate and releasably attachable to said bottom of said access frame. B8. The anchor system of B1 wherein: said access frame comprises a pair of half sections formed from a planar member with folded sides to provide a pair of vertical walls disposed at ninety degrees from each other, and a pair of horizontal walls to define said bottom of said access frame; a plurality of half section seal supports formed from a planar member with folded sides to provide a pair of vertical walls disposed at ninety degrees from each other, and a pair of offset vertical walls disposed at ninety degrees from each other, said offset vertical walls attachable to inner surfaces of said wall; and a plurality of half section turf ledges sections formed from a planar member with folded sides to provide a pair of vertical walls disposed at ninety degrees from each other, a pair of upper horizontal ledges disposed at ninety degrees from each other, and a pair of lower horizontal portions disposed at ninety degrees from each other. B9. The anchor system of B1 wherein said frame assembly comprises a drain attached to said wall of said access frame. B10. The anchor system of B1 wherein said first flexible seal comprises an upper portion and a downwardly-depending U-shaped portion. B11. The anchor system of B1 wherein: said cover plug comprises at least one stanchion engageable with the vertical member of the frame assembly; said platform of said cover plug comprises a peripheral, downwardly-depending wall; and said cover plug further comprising a plurality of L-shaped members having a horizontal leg attachable to said platform and a vertical leg for supporting a second flexible seal. B12. The anchor system of B1 wherein said at least one vertical member comprises a single vertical member. B13. The anchor system of B1 wherein said at least one vertical member comprises a pair of spaced apart vertical member.

C1. A method for forming an anchor system for releasably restraining a component or device from a synthetic turf field, the method comprising: excavating a portion of a support structure; securing an access frame to cement disposed in the excavated portion of the support structure, the access frame having a cavity and a vertical member accessible via the cavity; installing synthetic turf around the cavity of the access frame; and installing a cover plug having synthetic turf in the cavity. C2. The method of C1 wherein the securing comprises: securing the vertical member in the cement. C3. The method of C1 wherein the securing comprises: securing a support in the cement, the support comprising the vertical member and a horizontal plate disposed around the vertical member, and the vertical member disposed in the cement and the horizontal plate disposed on top of the cement. C4. The method of C1 further comprising: placing a sub-base material around the access frame between the cement and a horizontally outwardly-extending ledge of the access frame; and the installing comprises installing the synthetic turf around the access frame and over the horizontally outwardly-extending ledge. C5. The method of C1 further comprising inhibiting material from the synthetic turf from falling into the access frame via a first flexible seal extending vertically from and along a top periphery of the access frame. C6. The method of C1 wherein the installing the cover plug in the cavity of the access frame comprises engaging a downwardly-depending stanchion of the cover plug with the vertical member.

As may be recognized by those of ordinary skill in the art based on the teachings herein, numerous changes and modifications may be made to the above-described and other embodiments of the present disclosure without departing from the scope of the disclosure. The components of the implants as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the implants may include more or fewer components or features than the embodiments as described and illustrated herein. Accordingly, this detailed description of the currently-preferred embodiments is to be taken in an illustrative, as opposed to limiting of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The disclosure has been described with reference to the preferred embodiments. It will be understood that the architectural and operational embodiments described herein are exemplary of a plurality of possible arrangements to provide the same general features, characteristics, and general system operation. Modifications and alterations will occur to others upon a reading and understanding of the preceding detailed description. It is intended that the disclosure be construed as including all such modifications and alterations.

The invention claimed is:

1. A method for releasably restraining a base, a home plate, a double base, or a pitcher's rubber on an upper surface of a synthetic turf field, the method comprising:

removing a cover plug having synthetic turf from a frame assembly fixedly attached to a support structure under the synthetic turf field, the frame assembly having a vertically-extending peripheral outer wall and a bottom defining a cavity and at least one vertical member accessible via the cavity, an upper end of the vertically-extending peripheral outer wall defining an upper opening to the cavity of the frame assembly, the frame assembly having a vertically-extending first flexible seal extending from and above the upper end portion of the vertically-extending peripheral outer wall allowing access to the upper opening of the frame assembly;

positioning at least one downwardly-depending stanchion of the base, the home plate, the double base, or the pitcher's rubber over the cavity in the frame assembly;

lowering the at least one downwardly-depending stanchion of the base, the home plate, the double base, or the pitcher's rubber to engage the at least one vertical member accessible via the cavity; and disposing a bottom surface of the base, the home plate, the double base, or the pitcher's rubber over the cavity in the frame assembly and on the upper surface of the synthetic turf field around the peripheral wall of the frame assembly in the synthetic turf field.

2. The method of claim 1 wherein:

the at least one vertical member comprises a single vertical member;

the at least one stanchion comprises a single downwardly-depending stanchion of the base or home plate;

the positioning comprises positioning the single downwardly-depending stanchion of the base or the home plate over the cavity in the frame assembly;

the lowering comprises lowering the single downwardly-depending stanchion of the base or the home plate to engage the at least one vertical member accessible via the cavity; and the disposing comprises disposing the bottom surface of the base or the home plate over the cavity in the frame assembly and on the upper surface of the synthetic turf field around the peripheral wall of the frame assembly in the synthetic turf field.

3. The method of claim 2 wherein:

the single vertical member comprises an upper portion that extends into the cavity of the frame assembly.

4. The method of claim 2 wherein:

the single vertical member comprises a lower portion that extends below a bottom of the frame assembly.

5. The method of claim 2 wherein:

the single vertical member is aligned with a center of the peripheral wall.

6. The method of claim 2 wherein:

the single vertical member comprises a single vertical hollow sleeve accessible via the cavity; and the lowering comprises lowering the at least one downwardly-depending stanchion of the base or the home plate between the peripheral wall of the frame assembly and in a passageway in the single vertical hollow sleeve accessible via the cavity.

7. The method of claim 6 further comprising:

placing a stanchion support in the passageway of the single vertical hollow sleeve for supporting and leveling the base or the home plate.

8. The method of claim 1 wherein:

the cover plug comprises a single downwardly-depending stanchion; and the removing comprises removing the single downwardly-depending stanchion of the cover plug from the at least one vertical member.

9. The method of claim 2 further comprising:

removing the base or the home plate from the top surface of the synthetic field;

reinstalling the cover plug having synthetic turf in the cavity; and aligning a first flexible seal disposed around the synthetic turf of the cover plug adjacent to a second flexible seal disposed around the cavity.

10. The method of claim 1 wherein the at least one vertical member is a metal vertical member.

11. The method of claim 1 wherein the at least one vertical member comprises at least one vertical hollow sleeve that extends below the bottom of the frame assembly, and the at least one vertical hollow sleeve comprises a closed lower end disposable in the support structure.

12. The method of claim 11 wherein the at least one vertical hollow sleeve comprises a cap extending across the passageways of the vertical hollow sleeve to form the closed lower end of the vertical hollow sleeve, and the cap extending laterally outward from the vertical hollow sleeve.

13. The method of claim 11 wherein the at least one vertical hollow sleeve comprises an upper portion disposed in the cavity of the frame assembly.

14. The method of claim 11 further comprising at least one leveling stanchion support disposable in the passageway of the at least one vertical hollow sleeve for supporting the stanchion of the base, the home plate, the double base, or the pitcher's rubber.

15. The method of claim 1 wherein the frame assembly further comprises a horizontal plate secured to and disposed around the at least one vertical member to define a support for fixedly securing the frame assembly in the support structure.

16. The method of claim 15 further comprising a plurality of bolts extending through the horizontal plate, lower portions of the plurality of bolts being disposable below the horizontal plate and fixedly securable in the support structure, and upper portions of the plurality of bolts disposable above the horizontal plate and releasably attachable to the bottom of the frame assembly.

17. The method of claim 1 wherein:

the frame assembly comprises a pair of half sections formed from a planar member with folded sides to provide a pair of vertical walls disposed at ninety degrees from each other, and a pair of horizontal walls to define the bottom of the frame assembly;

a plurality of half section seal supports formed from a planar member with folded sides to provide a pair of vertical walls disposed at ninety degrees from each other, and a pair of offset vertical walls disposed at ninety degrees from each other, the offset vertical walls attachable to inner surfaces of the wall; and a plurality of half section turf ledges sections formed from a planar member with folded sides to provide a pair of vertical walls disposed at ninety degrees from each other, a pair of upper horizontal ledges disposed at ninety degrees from each other, and a pair of lower horizontal portions disposed at ninety degrees from each other.

18. The method of claim 1 wherein the frame assembly comprises a drain attached to the peripheral wall.

19. The method of claim 1 wherein the first flexible seal comprises an upper portion and a downwardly-depending U-shaped portion.

20. The method of claim 1 wherein:

the cover plug comprises at least one stanchion engageable with the vertical member of the frame assembly;

a platform of the cover plug comprises a peripheral, downwardly-depending wall; and the cover plug further comprising a plurality of L-shaped members having a horizontal leg attachable to the platform and a vertical leg for supporting a second flexible seal.

21. The method of claim 1 wherein the at least one vertical member comprises a single hollow vertical member for use in engaging the at least one stanchion comprising a single stanchion of the base or a single stanchion of the home plate.

22. The method of claim 1 wherein the at least one vertical member comprises a pair of spaced apart vertical members for use in engaging a pair of stanchions of the double base or a pair of stanchions of the pitcher's rubber.

23. The method of claim 1 further comprising:

locating the frame assembly in the support structure relative to a location of a baseball diamond.

24. The method of claim 1 further comprising:

excavating a portion of the support structure;

securing the frame assembly to cement disposed in the excavated portion of the support structure;

installing synthetic turf around the cavity of the frame assembly; and installing the cover plug having synthetic turf in the cavity.

25. The method of claim 24 wherein the securing comprises:

securing the vertical member in the cement.

26. The method of claim 24 wherein the securing comprises:

securing a support in the cement, the support comprising the vertical member and a horizontal plate disposed around the vertical member, and the vertical member disposed in the cement and the horizontal plate disposed on top of the cement.

27. The method of claim 24 further comprising:

placing a sub-base material around the frame assembly between the cement and a horizontally outwardly-extending ledge of the frame assembly; and the installing comprises installing the synthetic turf around the frame assembly and over the horizontally outwardly-extending ledge.

28. The method of claim 24 further comprising inhibiting material from the synthetic turf from falling into the frame assembly via a first flexible seal extending vertically from and along a top periphery of the frame assembly.

29. The method of claim 24 wherein the installing the cover plug in the cavity of the frame assembly comprises engaging a downwardly-depending stanchion of the cover plug with the vertical member.

30. A method for releasably restraining a base, a home plate, a double base, or a pitcher's rubber on an upper surface of a synthetic turf field, the method comprising:

removing a cover plug having synthetic turf from a frame assembly fixedly attached to a support structure under the synthetic turf field, the frame assembly having a peripheral wall and a bottom defining a cavity and at least one vertical member accessible via the cavity, the frame assembly having a first flexible seal extending above an upper opening of the peripheral wall of the frame assembly;

positioning at least one downwardly-depending stanchion of the base, the home plate, the double base, or the pitcher's rubber over the cavity in the frame assembly;

lowering the at least one downwardly-depending stanchion of the base, the home plate, the double base, or the pitcher's rubber to engage the at least one vertical member accessible via the cavity;

disposing a bottom surface of the base, the home plate, the double base, or the pitcher's rubber over the cavity in the frame assembly and on the upper surface of the synthetic turf field around the peripheral wall of the frame assembly in the synthetic turf field; and wherein the frame assembly comprises a pair of half sections formed from a planar member with folded sides to provide a pair of vertical walls disposed at ninety degrees from each other, and a pair of horizontal walls to define the bottom of the frame assembly;

a plurality of half section seal supports formed from a planar member with folded sides to provide a pair of vertical walls disposed at ninety degrees from each other, and a pair of offset vertical walls disposed at ninety degrees from each other, the offset vertical walls attachable to inner surfaces of the wall; and a plurality of half section turf ledges sections formed from a planar member with folded sides to provide a pair of vertical walls disposed at ninety degrees from each other, a pair of upper horizontal ledges disposed at ninety degrees from each other, and a pair of lower horizontal portions disposed at ninety degrees from each other.

* * * * *